US009766566B2

(12) United States Patent
Mochizuki et al.

(10) Patent No.: US 9,766,566 B2
(45) Date of Patent: Sep. 19, 2017

(54) TONER AND METHOD FOR PRODUCING THE SAME

(71) Applicant: CANON KABUSHIKI KAISHA, Tokyo (JP)

(72) Inventors: Shinsuke Mochizuki, Yokohama (JP); Kenichi Nakayama, Numazu (JP); Koji Abe, Numazu (JP); Toshihiko Katakura, Susono (JP); Masatake Tanaka, Yokohama (JP); Naoya Isono, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/165,982

(22) Filed: May 26, 2016

(65) Prior Publication Data

US 2016/0349649 A1 Dec. 1, 2016

(30) Foreign Application Priority Data

May 29, 2015 (JP) ..... 2015-110380

(51) Int. Cl.

| | |
|---|---|
| ***G03G 9/093*** | (2006.01) |
| ***G03G 9/097*** | (2006.01) |
| ***G03G 9/08*** | (2006.01) |
| *G03G 15/08* | (2006.01) |

(52) U.S. Cl.

CPC ..... *G03G 9/09321* (2013.01); *G03G 9/0806* (2013.01); *G03G 9/0821* (2013.01); *G03G 9/09733* (2013.01); *G03G 15/08* (2013.01)

(58) Field of Classification Search

CPC ..... G03G 9/09314

See application file for complete search history.

(56) References Cited

U.S. PATENT DOCUMENTS

2014/0186761 A1* 7/2014 Abe ..... G03G 9/09775 430/108.3

FOREIGN PATENT DOCUMENTS

| | | | |
|---|---|---|---|
| JP | 2001-75304 | A | 3/2001 |
| JP | 2006-146056 | A | 6/2006 |
| JP | 2010-145994 | A | 7/2010 |
| JP | 5084482 | B2 | 11/2012 |
| JP | 2014-211632 | A | 11/2014 |
| JP | 2015-4869 | A | 1/2015 |
| JP | 2015-96949 | A | 5/2015 |

* cited by examiner

*Primary Examiner* — Hoa V Le

(74) *Attorney, Agent, or Firm* — Canon USA Inc., IP Division

(57) ABSTRACT

A toner includes a toner particle including a surface layer containing an organosilicon polymer. The toner particle contains a styrene acrylic resin and a block polymer that has i) a polyester segment C and a vinyl polymer segment A, the mass ratio C/A of the polyester segment C to the vinyl polymer segment A being 40/60 to 80/20, and ii) a melting point Tm of 55° C. to 90° C. The organosilicon polymer has a partial structure represented by Rf—$SiO_{3/2}$.

9 Claims, 1 Drawing Sheet

TONER AND METHOD FOR PRODUCING THE SAME

BACKGROUND OF THE INVENTION

Field of the Invention

The present invention relates to a toner used in image-forming methods such as electrophotography, electrostatic recording, and a toner jet method and a method for producing such a toner.

Description of the Related Art

With the developments in computer and multimedia technologies, there has been a demand for a method for forming high-definition, full-color images in a variety of settings ranging from the office to the home.

In particular, image-forming apparatuses for use in offices, where a large amount of images are copied and printed, have been required to have high endurance with which a plurality of images can be copied or printed without degradation of image quality. Image-forming apparatuses for use in small offices and the home have been required to be capable of forming high-quality images. Furthermore, there has also been a demand for a reduction in the sizes of image-forming apparatuses for use in small offices and the home from the viewpoints of space saving, energy saving, and weight reduction. In order to meet these demands, improvements in the properties of a toner, such as low-temperature fixability, development endurance, and preservation stability, have been anticipated. There has also been a demand for a method for forming high-definition, full-color images which is suitable for prolonged use under various conditions, that is, various temperature and humidity conditions. In order to meet this demand, it may be advantageous to reduce a change in the amount of electrical charge on toner particles and a change in the properties of the surfaces of the toner particles which may be caused by the difference in the operating conditions such as temperature and humidity.

In order to address the above issues, Japanese Patent No. 5084482 discloses a toner that contains a crystalline resin serving as a binder resin, which lowers the softening point of the toner, enhances the low-temperature fixability of the toner, and increases the gloss of images.

Japanese Patent Laid-Open No. 2001-75304 discloses a polymerized toner including toner particles each including a cover layer constituted by silicon-compound-containing granular clusters adhering to one another in order to enhance the development endurance and preservation stability of the toner.

Japanese Patent Laid-Open No. 2006-146056 discloses a toner whose particles are each covered with inorganic fine particles adhered to one another in order to enhance the high-temperature-storage stability of the toner and print endurance in a normal-temperature, normal-humidity environment and a high-temperature, high-humidity environment.

Japanese Patent Laid-Open No. 2010-145994 discloses a toner that includes a polyhedral oligomeric silsesquioxane in order to improve the flowability and cohesiveness of the toner.

Due to the recent demands for further energy saving, longer service life, and higher stability, further improvements in the properties of the toner have been anticipated. In particular, a reduction in the likelihood of a release agent or a resin component included in toner particles including a crystalline resin bleeding from the insides of the toner particles to the surfaces (hereinafter, this phenomenon is referred to as "bleeding") has been anticipated. It has also been anticipated that the development endurance, the preservation stability, and the environmental stability of the toner be further improved.

SUMMARY OF THE INVENTION

The present invention provides a toner having high low-temperature fixability, high preservation stability, high development endurance, and high environmental stability. The present invention also provides a method for producing such a toner.

Specifically, the present invention provides a toner including a toner particle including a surface layer.

The toner particle contains a styrene acrylic resin and a block polymer. The surface layer contains an organosilicon polymer.

The organosilicon polymer has a partial structure represented by Formula (1) below.

$$Rf—SiO_{3/2} \quad (1)$$

where Rf represents an alkyl group having 1 to 6 carbon atoms, or a phenyl group.

The block polymer has a polyester segment C and a vinyl polymer segment A. The mass ratio C/A of the polyester segment C to the vinyl polymer segment A is 40/60 or more and 80/20 or less.

The polyester segment C has a structural unit represented by Formula (2) below.

The block polymer has a melting point Tm of 55° C. or more and 90° C. or less.

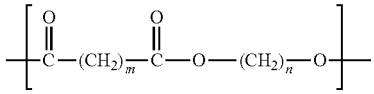

(2)

where m and n each independently represent an integer of 4 to 16.

The present invention also provides a method for producing a toner including the above-described toner particle.

The method includes:

forming a particle of a polymerizable monomer composition in an aqueous medium, the polymerizable monomer composition including a polymerizable monomer capable of forming the styrene acrylic resin, the block polymer, and a silicon compound capable of forming the organosilicon polymer, and polymerizing the polymerizable monomer included in the particle.

Further features of the present invention will become apparent from the following description of exemplary embodiments with reference to the attached drawings.

DESCRIPTION OF THE EMBODIMENTS

Figure 1:
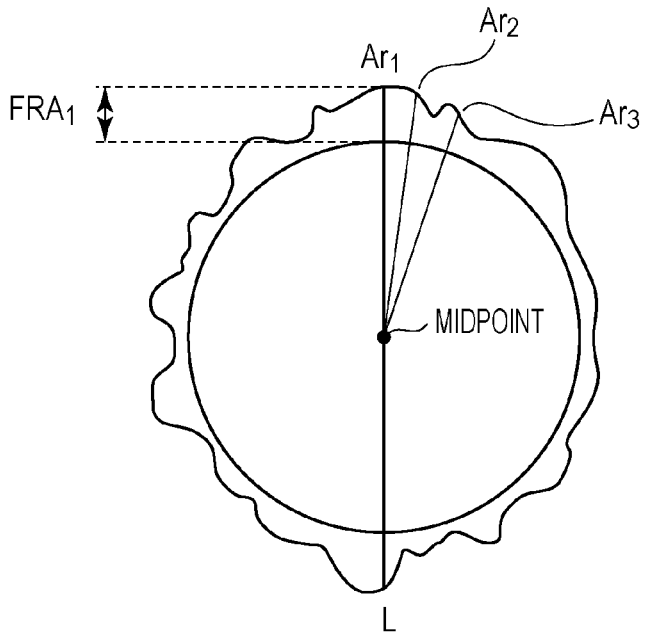
FIG. 1 is a conceptual diagram illustrating the definition of the thickness of the surface of a toner particle including an organosilicon compound.

An embodiment of the present invention is described below in detail.

The inventors of the present invention found that a toner having high low-temperature fixability, high preservation stability, and high endurance may be produced by adding an organosilicon polymer to surface layers of the toner particles and a styrene acrylic resin and a specific block polymer to the toner particles.

Specifically, the block polymer used in this embodiment is a crystalline resin, which has a sharp-melting property and high low-temperature fixability but low elasticity and a poor mechanical strength. Therefore, if the block polymer is used alone as a binder resin of a toner, the endurance of the toner may be degraded, which increases the likelihood of image defects, such as vertical streaks that extend in the paper-ejection direction, being caused by melted toner particles adhering to a developing roller or the like. Moreover, the polyester segment (i.e., a crystalline segment) of the block polymer serves as a site from which electrical charges leak. This considerably deteriorates the charge stability of the toner and increases the occurrence of fogging and the like. In the present invention, the inventors found that, by using a styrene acrylic resin in combination with the block polymer as a binder resin, the above issues may be addressed while the low-temperature fixability and the fixable temperature range of the toner are maintained. When toner particles include a block polymer having a vinyl polymer segment A having a high affinity for the styrene acrylic resin, the block polymer is highly dispersed among the styrene acrylic resin in the toner particle. This increases the toughness of the toner particle and enhances the endurance of the toner particles.

In a fixing process, upon the toner being supplied with heat, the block polymer having a low melting point instantaneously mixes with the styrene acrylic resin by using the vinyl polymer segment as an origin. As a result, plasticity is imparted to the toner. This lowers the softening point of the toner and enhances the low-temperature fixability of the toner. The vinyl polymer segment included in the block polymer enables the block polymer to have a suitable viscosity with which the toner particles are capable of being fixed when being melted. Therefore, the block polymer is capable of serving as a binder resin, and the low-temperature fixability of the toner may be achieved in a synergistic manner.

Organosilicon Polymer

The organosilicon polymer according to the embodiment is a hybrid inorganic-organic resin having the partial structure represented by Formula (1) above. The partial structure represented by Formula (1) above included in the organosilicon polymer includes a hydrophobic alkyl group or phenyl group represented by Rf, which reduces the occurrence of bleeding of a low-melting-point component contained inside the toner particles. This enhances the storage stability of the toner to a level at which the occurrence of blocking of toner particles can be reduced even when the toner is stored at a high temperature. Furthermore, the alkyl group or phenyl group represented by Rf in the Formula (1) above has good chargeability. This enables a toner also having high environmental stability to be produced.

The expression "—$SiO_{3/2}$" in Formula (1) means that each Si atom is bonded to three oxygen atoms, which are each bonded to another Si atom. Thus, the ratio of the number of Si atoms to the number of O atoms included in the organosilicon polymer is such that the organosilicon polymer includes three O atoms per two Si atoms. Therefore, the expression "—$SiO_{3/2}$" is used. For example, in the case where the Si atom is bonded to an OH group, the expression is "Rf-$SiO_{2/2}$—OH". This structure is analogous to that of a disubstituted silicone resin such as dimethyl silicone.

The —$SiO_{3/2}$ structure of the organosilicon polymer is considered to have properties analogous to those of silica ($SiO_2$), which is constituted by a number of siloxane structures. Therefore, it is considered that the toner according to the embodiment is analogous to a toner that includes silica. It is also considered that the organosilicon polymer, which includes the group Rf, has some characteristics different from those of silica.

In the toner particles according to the embodiment, in a $^{29}$Si-NMR measurement of a tetrahydrofuran-insoluble matter of the toner particles, the ratio of the peak area corresponding to the partial structure represented by Formula (1) to the total peak area corresponding to the organosilicon polymer is preferably 5.0% or more. This means that 5.0% or more of the number of silicon atoms contained in the organosilicon polymer included in the toner particles constitute the partial structure represented by —$SiO_{3/2}$. It is considered that, when the ratio of the peak area corresponding to the partial structure represented by Formula (1) is 5.0% or more, the organosilicon polymer becomes hard as silica. This is presumably one of the reasons for which the endurance and preservation stability of the toner are further enhanced. The ratio of the peak area corresponding to the partial structure represented by Formula (1) above is preferably 10.0% or more and is more preferably 20.0% or more. The ratio of the peak area corresponding to the partial structure represented by Formula (1) above to the total peak area corresponding to the organosilicon polymer is preferably 100.0% or less in order to enhance the development endurance and environmental stability of the toner. The ratio of the peak area corresponding to the partial structure represented by Formula (1) above can be controlled by changing the reaction temperature, the reaction time, the reaction solvent, and pH in the formation of the partial structure represented by Formula (1) above.

In this embodiment, Rf in Formula (1) represents an alkyl group having 1 to 6 carbon atoms, or a phenyl group. Rf in Formula (1) is preferably an alkyl group having 1 to 3 carbon atoms (i.e., a methyl group, an ethyl group, or a propyl group) in order to further enhance the chargeability of the toner and reduce the occurrence of fogging. Rf in Formula (1) is most preferably a methyl group from the viewpoints of the environmental stability and preservation stability of the toner.

One of the monomers used for producing the organosilicon polymer having the partial structure represented by Formula (1) above is an organosilicon compound represented by Formula (3) below.

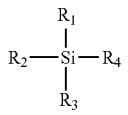

(3)

In Formula (3), $R_1$ is a group that is to serve as Rf in the structure represented by Formula (1). $R_1$ represents an alkyl group having 1 to 6 carbon atoms, or a phenyl group.

$R_2$ to $R_4$ each independently represent a halogen atom, a hydroxy group, an acetoxy group, or an alkoxy group (hereinafter, referred to as "reactive groups").

The above reactive groups undergo hydrolysis, addition polymerization, and condensation polymerization to form a crosslinked structure, which reduces the likelihood of the toner particles contaminating members and enhances the development endurance of the toner. The reactive groups are preferably selected from a methoxy group and an ethoxy group from the viewpoints of ease of precipitation and coatability on the surfaces of the toner particles because they undergo mild hydrolysis at room temperature. The hydrolysis, addition polymerization, and condensation polymerization of the groups $R_2$ to $R_4$ can be controlled by changing the reaction temperature, the reaction time, the reaction solvent, and pH.

In order to produce the organosilicon polymer used in this embodiment, organosilicon compounds including three reactive groups other than $R_1$ in Formula (3) above (i.e., $R_2$, $R_3$, and $R_4$) per molecule may be used alone or in combination of two or more. Hereinafter, such organosilicon compounds are referred to as "trifunctional silanes".

In this embodiment, the amount of the organosilicon polymer is preferably 0.5% by mass or more and 4.0% by mass or less of the total amount of the toner particles. When the content of the organosilicon polymer is 0.5% by mass or more, the occurrence of bleeding may be reduced by the organosilicon polymer to a sufficient degree and, as a result, the heat resistance of the toner may be enhanced. When the content of the organosilicon polymer is 4.0% by mass or less, the degradation of the fixability of the toner which is caused by the organosilicon polymer may be minimized and, as a result, the fixability of the toner may be enhanced.

Examples of the organosilicon compounds represented by Formula (3) above include:

trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane;

trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane; and trifunctional phenylsilanes such as phenyltrimethoxysilane, phenyltriethoxysilane, phenyltrichlorosilane, phenyltriacetoxysilane, and phenyltrihydroxysilane.

The content of the organosilicon compound having the structure represented by Formula (3) in the organosilicon polymer used in this embodiment is preferably 50% by mole or more and is more preferably 60% by mole or more. Setting the content of the organosilicon compound having the structure represented by Formula (3) to 50% by mole or more may further enhance the environmental stability of the toner.

An organosilicon compound including four reactive groups per molecule (i.e., tetrafunctional silane), an organosilicon compound including three reactive groups per molecule (i.e., trifunctional silane), an organosilicon compound including two reactive groups per molecule (i.e., bifunctional silane), and an organosilicon compound including one reactive group per molecule (i.e., monofunctional silane) may be used in combination with the organosilicon compound having the structure represented by Formula (3) in order to produce the organosilicon polymer used in this embodiment as long as the advantageous effects of the present invention are not impaired.

Specific examples of the organosilicon compounds that can be used in combination with the organosilicon compound having the structure represented by Formula (3) include dimethyldiethoxysilane, tetraethoxysilane, hexamethyldisilazane, 3-glycidoxypropyltrimethoxysilane, 3-glycidoxypropylmethyldiethoxysilane, 3-glycidoxypropyltriethoxysilane, p-styryltrimethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane, 3-phenylaminopropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, 3-glycidoxypropyltrimethoxysilane, 3-glycidoxypropylmethyldimethoxysilane, 3-glycidoxypropylmethyldiethoxysilane, hexamethyldisiloxane, tetraisocyanatesilane, methyltriisocyanatesilane, vinyltriisocyanatesilane, vinyltrimethoxysilane, vinyltriethoxysilane, vinyldiethoxymethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane, vinyldiethoxyhydroxysilane, allyltrimethoxysilane, allyltriethoxysilane, allyltrichlorosilane, allyltriacetoxysilane, and allyltrihydroxysilane.

One of the common methods for producing the organosilicon polymer used in this embodiment is a "sol-gel" method.

The sol-gel method is a method in which a metal alkoxide M(OR)n (M: metal, O: oxygen, R: hydrocarbon, n: the oxidation number of the metal), which serves as a starting material, is subjected to hydrolysis and condensation polymerization in a solvent, thereby formed into a sol, and finally gelated. The sol-gel method is used for the synthesis of glass, ceramics, hybrid inorganic-organic resins, or nanocomposites. This production method enables high-performance materials having various shapes such as a surface layer, fibers, a bulk body, and fine particles to be produced from a liquid phase at low temperatures.

Specifically, for producing the organosilicon polymer included in the toner particles, hydrolysis and condensation polymerization of a silicon compound such as alkoxysilane may be performed.

The organosilicon polymer is included in the surface layers of the toner particles. Coating the surfaces of the toner particles with surface layers including the organosilicon polymer enhances the environmental stability of the toner even when inorganic fine particles are not adhered to or deposited on the surfaces of the toner particles as in the production of common toners. In addition, the degradation of the performance of the toner which may occur when the toner is used for a long period of time may be limited. That is, a toner having high preservation stability may be produced.

In the sol-gel method, a solution is used as a starting material and a material is produced by gelating the solution. This enables materials having various microstructure and shapes to be produced. In particular, in the case where toner particles are produced in an aqueous medium, the organosilicon compound may be readily deposited on the surfaces of the toner particles due to the hydrophilicity of the hydrophilic groups of the organosilicon compound, such as a silanol group.

However, if the hydrophobicity of the organosilicon compound is high (e.g., if the organosilicon compound includes a highly hydrophobic functional group), it becomes difficult to deposit the organosilicon compound on the surface layers of the toner particles. Consequently, it becomes difficult to form surface layers including the organosilicon polymer on the toner particles. On the other hand, if the number of carbon atoms included in the hydrocarbon group of the organosilicon compound is zero, the hydrophobicity of the organosilicon compound becomes excessively low and the charge stability of the toner may be accordingly degraded. The microstructure and shape of the organosilicon polymer may be controlled by changing the reaction temperature, the reaction time, the reaction solvent, the pH, the type and amount of organosilicon compound, and the like.

It is known that, in general, the state of siloxane linkages formed in the sol-gel reaction varies depending on the acidity of the reaction medium used. Specifically, in the case where an acidic reaction medium is used, a hydrogen ion is electrophilically added to an oxygen atom of one reactive group (e.g., an alkoxy group (—OR group)). Subsequently, the oxygen atom of a water molecule coordinates a silicon atom, which is formed into a hydrosilyl group by a substitution reaction. In the presence of a sufficient amount of water, one $H^+$ ion attacks an oxygen atom of one reactive group (e.g., an alkoxy group (—OR group)). Thus, in the case where the content of $H^+$ ions in the reaction medium is low, the rate of the substitution reaction to a hydroxy group may be reduced. Therefore, a condensation polymerization reaction occurs prior to the hydrolysis of all the reactive groups bonded to a silicon atom. As a result, one-dimensional, linear polymers and two-dimensional polymers are likely to be produced in a relatively easy manner.

On the other hand, in the case where an alkaline reaction medium is used, a hydroxide ion is added to a silicon atom to form a pentacoordinate intermediate. This increases the likelihood of elimination of all the reactive groups (e.g., alkoxy groups (—OR groups)), that is, the likelihood of formation of silanol groups due to a substitution reaction. In particular, in the case where a silicon compound including three or more reactive groups per silicon atom is used, hydrolysis and condensation polymerization may occur three-dimensionally and an organosilicon polymer including a number of three-dimensional crosslinkages may be formed. Furthermore, the reaction may be completed in a short period of time.

Accordingly, for forming the organosilicon polymer, an alkaline reaction medium may be advantageously used in the sol-gel reaction. Specifically, in the case where the organosilicon polymer is produced in an aqueous medium, the pH of the reaction medium is preferably set to 8.0 or more. This enables an organosilicon polymer having a high strength and high endurance to be formed. The sol-gel reaction is preferably conducted at a reaction temperature of 90° C. or more for a reaction time of 5 hours or more.

Conducting the sol-gel reaction at the above reaction temperature for the above reaction time reduces the likelihood of silane compounds present on the surfaces of the toner particles in the form of a sol or a gel being coagulated to form coalesced particles.

Organotitanium compounds and organoaluminium compounds may be used in combination with the above organosilicon compounds as long as the advantageous effects of the present invention are not impaired.

Examples of the organotitanium compounds include titanium methoxide, titanium ethoxide, titanium n-propoxide, tetra-i-propoxytitanium, tetra-n-butoxytitanium, titanium isobutoxide, titanium butoxide dimer, titanium tetra-2-ethylhexoxide, titanium diisopropoxy bis(acetylacetonate), titanium tetraacetylacetonate, titanium di-2-ethylhexoxy bis(2-ethyl-3-hydroxyhexoxide), titanium diisopropoxy bis (ethylacetoacetate), tetrakis(2-ethylhexyloxy)titanium, di-i-propoxy bis(acetylacetonate)titanium, titanium lactate, titanium methacrylate isopropoxide, triisopropoxy titanate, titanium methoxypropoxide, and titanium stearyloxide.

Examples of the organoaluminium compounds include aluminium(III)-n-butoxide, aluminium(III)-s-butoxide, aluminium(III)-s-butoxide bis(ethylacetoacetate), aluminium (III) t-butoxide, aluminium(III) di-s-butoxide ethylacetoacetate, aluminium(III) diisopropoxide ethylacetoacetate, aluminium(III) ethoxide, aluminium(III) ethoxyethoxyethoxide, aluminium hexafluoropentanedionate, aluminium (III) 3-hydroxy-2-methyl-4-pyronate, aluminium(III) isopropoxide, aluminium-9-octadecenylacetoacetate diisopropoxide, aluminium(III) 2,4-pentanedionate, aluminium phenoxide, and aluminium(III) 2,2,6, 6-tetramethyl-3,5-heptanedionate.

The above compounds may be used alone or in combination of two or more. The amount of electrical charge on the toner particles can be controlled by using these compounds in proper combination and changing the amounts of the compounds added.

In the toner according to this embodiment, in X-ray photoelectron spectroscopic analysis (ESCA) of a surface of the toner particle, the ratio of silicon atoms on the surface of the toner particle calculated by the following formula is preferably 0.025 or more, is more preferably 0.050 or more, and is further preferably 0.150 or more. The ratio of silicon atoms on the surfaces of the toner particles is determined by X-ray photoelectron spectroscopy (i.e., electron spectroscopy for chemical analysis (hereinafter, abbreviated as "ESCA")) by using the following formula.

$$dSi/(dC+dO+dSi+dS)$$

where dC represents the intensity corresponding to carbon atoms, dO represents the intensity corresponding to oxygen atoms, dSi represents the intensity corresponding to silicon atoms, and dS represents the intensity corresponding to sulfur atoms.

Setting the ratio of silicon atoms on the surfaces of the toner particles to 0.025 or more reduces the amount of surface free energy of the toner particles. Setting the ratio of the silicon atoms to 0.025 or more also enhances the flowability of the toner and reduces the occurrence of fogging. This enhances the endurance and developability of the toner. The ratio of silicon atoms on the surfaces of the toner particles is 0.333 or less from the viewpoint of the chargeability of the toner.

The ratio of silicon atoms on the surfaces of the toner particles can be controlled by changing the structure of Rf in Formula (1) above; the method for producing the toner; the reaction temperature, the reaction time, the reaction solvent, and the pH in the formation of the organosilicon polymer; and the content of the organosilicon polymer.

The average thickness Dav. of the surface layers of the toner particles, the surface layers including the organosilicon polymer, which is determined by transmission electron microscope (TEM) imaging of cross sections of the toner particles is preferably 5.0 nm or more and 150.0 nm or less.

The average thickness Dav. is defined in the following manner. A chord that gives the longest diameter of the cross section of a toner particle is considered to be a major axis L. A point at which the major axis L intersects a line segment a perpendicular to the major axis L which passes through the midpoint of the major axis L is considered to be the center. Using the midpoint of the major axis L as a center, the cross section of the toner particle is divided into 32 equal sections at the same relative angle (11.25°). The parting axes that extend from the center toward the surface of the toner particle are denoted by $Ar_n$, where n=1 to 32. The average thickness Dav. of the surface layer of the toner particle is the arithmetic average of $FRA_n$ (n=1 to 32), which denotes the lengths of line segments that lie within the surface layer of the toner particle on the respective parting axes $Ar_n$ (n=1 to 32) (See FIG. 1).

Setting the average thickness Dav. of the surface layers of the toner particles to be within the above range reduces the occurrence of bleeding of a resin component, a release agent, or the like included in the insides of the toner particles. This enables a toner having high preservation stability, high environmental stability, and high development endurance to be produced. The average thickness Dav. of the surface layers of the toner particles is preferably 7.5 nm or more and 125.0 nm or less and is more preferably 10.0 nm or more and 100.0 nm or less from the viewpoint of the preservation stability of the toner.

The average thickness Dav. of the surface layers of the toner particles, the surface layers including the organosilicon polymer, can be controlled by changing the structure of Rf in Formula (1) above; the number of the hydrophilic groups; the reaction temperature, the reaction time, the reaction solvent, and the pH in the addition polymerization reaction and the condensation polymerization reaction; and the amount of the organosilicon polymer used.

Block Polymer

The block polymer included in the toner according to the embodiment is described below.

The block polymer has the following three features.

i) The block polymer has a polyester segment C and a vinyl polymer segment A. The mass ratio (C/A) of the polyester segment C to the vinyl polymer segment A is 40/60 or more and 80/20 or less.

ii) The polyester segment C has a structural unit represented by Formula (2) below.

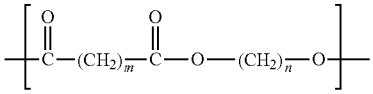

(2)

where m and n each independently represent an integer of 4 to 16.

iii) The block polymer has a melting point (Tm) of 55° C. or more and 90° C. or less.

The above features of the block polymer are each described below.

The block polymer has a melting point (Tm) of 55° C. or more and 90° C. or less. A block polymer having a melting point (Tm) of less than 55° C., which may increase occurrence of blocking of the toner particles, is disadvantageous from the viewpoint of the storage stability of the toner. A block polymer having a melting point (Tm) of more than 90° C., which may increase the temperature required to melt the block polymer, is disadvantageous from the viewpoint of the low-temperature fixability of the toner. The block polymer more preferably has a melting point (Tm) of 60° C. or more and 85° C. or less.

The melting point of the block polymer can be controlled by changing the monomers constituting the polyester segment and the ratio between the amount of polyester segment and the amount of vinyl polymer segment.

The polyester segment C of the block polymer has the structural unit represented by Formula (2). Since the block polymer has the polyester segment C having the structural unit represented by Formula (2), the block polymer and the styrene acrylic resin are separated from each other as independent phases when the toner particles are not melted and are mixed with each other when the toner particles are melted.

Monomers constituting the polyester segment C may be produced by reacting the dicarboxylic acid represented by Formula (A) below, an alkyl ester of the dicarboxylic acid, or an intermolecular acid anhydride of the dicarboxylic acid with the diol represented by Formula (B) below. The polyester segment having the structural unit represented by Formula (2) is produced by condensation polymerization of these monomers.

$$HOOC—(CH_2)_m—COOH \quad (A)$$

where m is an integer of 4 to 16 (preferably 6 to 12).

$$HO—(CH_2)_n—OH \quad (B)$$

where n is an integer of 4 to 16 (preferably 6 to 12).

The dicarboxylic acid may be, for example, a dicarboxylic acid whose carboxyl group is converted into an alkyl ester (preferably having 1 to 4 carbon atoms) or an intermolecular acid anhydride as long as the dicarboxylic acid is capable of forming the same partial skeleton at the polyester segment as that formed by the above-described dicarboxylic acid.

Examples of the dicarboxylic acid include suberic acid, sebacic acid, dodecanedioic acid, and tetradecanedioic acid.

Examples of the diol include 1,5-pentanediol, 1,6-hexanediol, 1,7-heptanediol, 1,9-nonanediol, 1,10-decanediol, and 1,12-dodecanediol.

The vinyl polymer segment A of the block polymer may be synthesized from publicly known vinyl monomers such as styrene, methyl methacrylate, and n-butyl acrylate. In particular, the vinyl polymer segment A of the block polymer may be synthesized from styrene. A vinyl polymer segment A including a unit derived from styrene serves as a segment at which the block polymer starts mixing with the styrene acrylic resin in an effective manner and enhances the plasticity of melted toner particles.

The mass ratio (C/A) of the polyester segment C to the vinyl polymer segment A of the block polymer is 40/60 or more and 80/20 or less. If the mass ratio (C/A) is less than 40/60, the characteristics of the polyester segment may become small and, accordingly, the sharp-melting property and low-temperature fixability of the toner are likely to be degraded. If the mass ratio (C/A) is more than 80/20, conversely, the characteristics of the polyester segment may become excessive, which may deteriorate the endurance of the toner.

The weight-average molecular weight (Mw) of the block polymer is preferably 15,000 or more and 45,000 or less, is more preferably 20,000 or more and 40,000 or less, and is particularly preferably 23,000 or more and 37,000 or less. The ratio (Mw/Mn) of the weight-average molecular weight (Mw) to the number-average molecular weight (Mn) of the block polymer is 1.5 or more and 3.5 or less. When the weight-average molecular weight of the block polymer is 15,000 or more (more preferably 20,000 or more), the mechanical strength of the block polymer is high, which results in high endurance of the toner. When the weight-average molecular weight of the block polymer is 45,000 or less, the mobility of molecules is not likely to be reduced. This makes it easy to enhance the plasticity of melted toner particles.

The weight-average molecular weight (Mw) of the vinyl polymer segment is preferably 4,000 or more and 15,000 or less. When the weight-average molecular weight (Mw) of the vinyl polymer segment falls within the above range, the vinyl polymer segment is likely to serve as a point at which the block polymer starts mixing with the styrene acrylic resin and, consequently, the low-temperature fixability of the toner may be improved. The weight-average molecular weight (Mw) of the vinyl polymer segment can be controlled by changing the amount of initiator used, the timing at which the initiator is used, the reaction temperature, and the like.

The amount of the block polymer is preferably 2.0% by mass or more and 50.0% by mass or less, is more preferably 5.0% by mass or more and 50.0% by mass or less, and is further preferably 20.0% by mass or more and 40.0% by mass or less of the total amount of the block polymer and the styrene acrylic resin.

When the content of the block polymer is 2.0% by mass or more (more preferably, 5.0% by mass or more), the capability of the block polymer to enhance the plasticity of the melted toner particles and to serve as a binder resin, which are the advantageous effects of the present invention, may be readily achieved. As a result, the low-temperature fixability of the toner may be enhanced. When the content of the block polymer is 50.0% by mass or less, the likelihood of electrical charge leaking from the crystalline polyester segment may be reduced. This limits the degradation of the chargeability of the toner and occurrence of fogging. This also limits the degradation of the stress resistance and endurance of the toner. As a result, the occurrence of image defects such as development stripes may be reduced.

When the proportion of the amount of the block polymer to the total amount of the block polymer and the styrene acrylic resin is denoted by X (mass %) and the proportion of the amount of the organosilicon polymer to the total amount of the toner particles is denoted by Y (mass %), the ratio X/Y is preferably 1.5 or more and 30.0 or less and is more preferably 2.0 or more and 20.0 or less. Setting the ratio X/Y to be within the above range further limits the degradation of the chargeability of the toner and the occurrence of fogging. Furthermore, the uniformity of the distribution of electrical charges on the toner particles may be increased. This reduces the likelihood of ghosting occurring due to components of the toner which have been excessively charged in a low-temperature, low-humidity environment. In general, the amount of electrical charge on the toner particles is likely to be large in a low-temperature, low-humidity environment. In particular, the amount of highly charged component is likely to be large. This increases the likelihood of the toner particles not being removed from but remaining on a toner-carrying member. As a result, in a nonprinted region or the like, the amount of toner particles deposited on the toner-carrying member which have not been used for printing becomes larger than the amount of toner particles deposited on the toner-carrying member which have been used for printing. This causes ghosting. The organosilicon polymer according to this embodiment, which includes an alkyl group or a phenyl group represented by Rf, is considered to have a high affinity for the alkyl group included in the polyester segment of the block polymer. Furthermore, the block polymer includes a specific proportion or more of the vinyl polymer segment A having a high affinity for the styrene acrylic resin. Therefore, it is considered that the organosilicon polymer included in the surface layers of the toner particles is brought into intimate contact with the block polymer and the styrene acrylic resin that are included in the cores of the toner particles. It is considered that this enables electrical charge generated in the organosilicon polymer included in the surface layers to be distributed from the surface layers to the insides of the toner particles uniformly via the block polymer and, as a result, the chargeability of the toner may be further stabilized. In particular, generation of excessive electrical charge at the surfaces of the toner particles in a low-temperature, low-humidity environment may be reduced. This effectively reduces the amount of highly charged component and the occurrence of ghosting. Setting the ratio X/Y to 1.5 or more (more preferably, 2.0 or less) makes it easy to reduce the amount of highly charged component and the occurrence of ghosting. Setting the ratio X/Y to 30.0 or less (more preferably, 20.0 or less) may limit the degradation of the chargeability of the toner and occurrence of fogging.

According to "IUPAC Commission on Macromolecular Nomenclature, Glossary of Basic Terms in Polymer Science", The Society of Polymer Science, a block polymer is defined as a polymer constituted by a plurality of blocks connected linearly to one another. This embodiment conforms to the definition of the block polymer.

Styrene Acrylic Resin

Polymerizable monomers constituting the styrene acrylic resin may be a radically polymerizable vinyl monomer. The polymerizable vinyl monomer may be a monofunctional polymerizable monomer or a polyfunctional polymerizable monomer. Note that, the term "monofunctional polymerizable monomer" used herein refers to a monomer including one polymerizable unsaturated group, and the term "polyfunctional polymerizable monomer" used herein refers to a monomer including a plurality of polymerizable unsaturated groups.

Examples of the monofunctional polymerizable monomer include:

styrene derivatives such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

polymerizable acrylic monomers such as methyl acrylate, ethyl acrylate, n-propyl acrylate, isopropyl acrylate, n-butyl acrylate, isobutyl acrylate, tert-butyl acrylate, n-pentyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; and polymerizable methacrylic monomers such as methyl methacrylate, ethyl methacrylate, n-propyl methacrylate, isopropyl methacrylate, n-butyl methacrylate, isobutyl methacrylate, tert-butyl methacrylate, n-pentyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

Examples of the polyfunctional polymerizable monomer include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

The above monofunctional polymerizable monomers may be used alone or in combination of two or more. Alternatively, the above monofunctional polymerizable monomers and the above polyfunctional polymerizable monomers may be used in combination. In another case, the above polyfunctional polymerizable monomers may be used alone or in combination of two or more. Among the above polymerizable monomers, styrene and styrene derivatives may be advantageously used alone or in combination of two or more from the viewpoints of the developability and endurance of the toner. In such a case, styrene and styrene derivatives may be mixed with other polymerizable monomers.

The solubility parameter (SP) of the styrene acrylic resin is preferably 9.45 or more and 9.90 or less and is more preferably 9.50 or more and 9.85 or less. The absolute value (ΔSP) of the difference between the SP of the styrene acrylic resin and the SP of the block polymer is preferably 0.03 or more and 0.25 or less. Setting the ΔSP to be within the above range makes it easy to achieve the state in which the styrene acrylic resin and the block polymer are separated from each other as independent phases when the toner particles are not melted and the state in which the styrene acrylic resin and the block polymer are mixed with each other when the toner particles are melted in a balanced manner.

Method for Producing Toner Particles

The method for producing the toner particles is described below.

A specific example of the method for adding the organosilicon polymer to the surface layers of the toner particles is described below. However, the present invention is not limited to the following production method.

The first example production method is a method in which a polymerizable monomer composition that includes organosilicon compounds capable of forming the organosilicon polymer, polymerizable monomers capable of forming the styrene acrylic resin, and the block polymer is formed into particles (i.e., granulated) in an aqueous medium and the polymerizable monomers included in the particles are subsequently polymerized in order to produce toner particles. Hereinafter, this method is referred to as "suspension polymerization method".

The second example production method is a method in which, after the toner base particles have been prepared, the toner base particles are charged into an aqueous medium, and surface layers composed of the organosilicon polymer are subsequently formed on the toner base particles in the aqueous medium. The toner base particles may be produced by melting and kneading the styrene acrylic resin and the block polymer with each other and pulverizing the resulting mixture. In such a case, this method is referred to as a "pulverization method". Alternatively, the toner base particles may also be produced by coagulation and association of particles of the styrene acrylic resin and particles of the block polymer in an aqueous medium. In such a case, this methods is referred to as an "emulsification coagulation method". In another case, the toner base particles may be produced by dissolving the styrene acrylic resin, organosilicon compounds capable of forming the organosilicon polymer, and the block polymer in an organic solvent, suspending the resulting organic-phase dispersion in an aqueous medium in order to form particles (i.e., perform granulation), and removing the organic solvent after polymerization. In such a case, this method is referred to as a "dissolution suspension method".

The third example production method is a method in which toner particles are produced by dissolving the binder resin, organosilicon compounds capable of forming the organosilicon polymer, and the block polymer in an organic solvent, suspending the resulting organic-phase dispersion in an aqueous medium in order to form particles (i.e., perform granulation), and removing the organic solvent after polymerization.

The fourth example production method is a method in which toner particles are formed (i.e., granulation is performed) by performing coagulation and association of particles of the styrene acrylic resin, particles of the block polymer, and particles containing organosilicon compounds capable of forming the organosilicon polymer that are in the form of a sol or a gel in an aqueous medium.

The fifth example production methods id a method in which a solvent containing organosilicon compounds capable of forming the organosilicon polymer, which may have been polymerized to a certain degree, is injected onto the surfaces of the toner base particles by spray drying and the resulting surfaces of the matrices are polymerized or dried by using hot air or cooling in order to form surface layers composed of the organosilicon polymer on the toner particles. The toner base particles may be produced as in the production of toner base particles in the second example production method described above.

Toner particles produced by the above production methods include the organosilicon polymer formed in the vicinities of the surfaces of the toner particles. Thus, such toner particles have high environmental stability (in particular, high chargeability under severe conditions). Furthermore, the change in the conditions of the surfaces of the toner particles which may be caused due to bleeding of a resin included inside the toner particles or a release agent that may be optionally added to the toner particles even under the severe conditions may be limited.

The method for producing toner particles is further described below by taking a suspension polymerization method as an example. The suspension polymerization method is one of the most suitable methods for producing toner particles which may be employed in this embodiment.

Polymerizable monomers capable of forming the above-described styrene acrylic resin, a specific block polymer, silicon compounds capable of forming the organosilicon polymer, and, as needed, other additives such as a colorant and a wax are dissolved or dispersed uniformly with a dispersing machine. In the resulting solution or dispersion, a radical polymerization initiator (hereinafter, referred to simply as "polymerization initiator") is dissolved. Thus, a polymerizable monomer composition is prepared. The polymerizable monomer composition is suspended in an aqueous medium containing a dispersion stabilizer and polymerized. Subsequently, the organosilicon polymer is produced by a sol-gel reaction. Thus, toner particles are produced. Examples of the dispersing machine include a homogenizer, a ball mill, a colloid mill, and an ultrasonic dispersing machine.

The addition of the polymerization initiator may be done at the same time as the other additives are added to the polymerizable monomers or immediately before the polymerizable monomer composition is suspended in the aqueous medium. Alternatively, a solution of a polymerization initiator in the polymerizable monomers or a solvent may be added to the polymerizable monomer composition immediately after the granulation has been performed and before the polymerization reaction is started.

The toner according to the embodiment may include publicly known waxes. Specific examples of the waxes include petroleum waxes such as a paraffin wax, a microcrystalline wax, petrolatum and the derivatives thereof; a montan wax and the derivative thereof; a hydrocarbon wax produced by the Fischer-Tropsch process and the derivative thereof; polyolefin waxes such as a polyethylene wax and the derivatives thereof; natural waxes such as a carnauba wax and a candelilla wax and the derivatives thereof, where the term "derivative" used herein also refers to an oxide, a block copolymer with a vinyl monomer, and a graft-modified product; alcohols such as higher aliphatic alcohols; aliphatic acids such as stearic acid and palmitic acid and compounds produced from these aliphatic acids; acid amides, esters, ketones, hydrogenated castor oil, and the derivatives thereof; vegetable waxes; and animal waxes. The above waxes may be used alone or in combination of two or more.

Among these waxes, a polyolefin wax, a hydrocarbon wax produced by the Fischer-Tropsch process, and a petroleum wax may further improve the developability and transferability of the toner. An appropriate amount of antioxidant which does not deteriorate the chargeability of the toner may optionally be added to the wax component. The amount of the wax component used is preferably 1.0 to 30.0 parts by mass relative to 100.0 parts by mass of the binder resin (i.e., total amount of the styrene acrylic resin and the block polymer).

The melting point of the wax component used in this embodiment is preferably 30° C. to 120° C. and is more preferably 60° C. to 100° C.

In this embodiment, the following organic pigments, organic dyes, and inorganic pigments may be used as colorants.

Examples of cyan colorants include a copper phthalocyanine compound and the derivative thereof, an anthraquinone compound, and a basic dye lake compound. Specific examples thereof include C.I. Pigment Blue 1, 7, 15, 15:1, 15:2, 15:3, 15:4, 60, 62, and 66.

Examples of magenta colorants include condensed azo compounds, diketopyrrolopyrrole compounds, anthraquinone, quinacridone compounds, basic dye lake compounds, naphthol compounds, benzimidazolones, thioindigo compounds, and perylenes. Specific examples thereof include C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 254 and C.I. Pigment Violet 19.

Examples of yellow colorants include condensed azo compounds, isoindolinones, anthraquinones, azo metal complexes, methine compounds, and arylamides. Specific examples thereof include C.I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

Examples of black colorants include carbon black and black colorants prepared using the above yellow, magenta, and cyan colorants.

The above colorants may be used alone, in a mixture of two or more, or in the form of a solid solution. In this embodiment, the colorants are selected in consideration of hue angle, color saturation, lightness value, light fastness, OHP transparency, and dispersibility in toner particles.

The amount of the colorant used is preferably 1.0 to 20.0 parts by mass relative to 100.0 parts by mass of the binder resin (i.e., the total amount of the styrene acrylic resin and the block polymer).

In the case where toner particles are produced by the suspension polymerization method, a colorant to which hydrophobicity has been imparted using a substance that does not inhibit polymerization may be used in consideration of the polymerization-inhibiting property and water-phase-transition property of the colorant. One of the suitable methods for imparting hydrophobicity to a dye is a method in which polymerizable monomers are polymerized in the presence of the dye to form a colored polymer. The colored polymer is added to the polymerizable monomer composition.

It is possible to impart hydrophobicity to carbon black by using a substance capable of reacting the functional groups present on the surface of the carbon black (i.e., polyorganosiloxane) in addition to the above-described method for imparting hydrophobicity to a dye.

Optionally, a charge control agent may be used. A charge control agent that increases the speed of triboelectric charging and enables a certain amount of triboelectric charge to be maintained in a consistent manner may be used. In particular, in the case where toner particles are produced by the suspension polymerization method, a charge control agent that is not likely to inhibit polymerization and does not substantially contain a component soluble in an aqueous medium may be used.

There are two types of charge control agents: the one that controls a toner to be negatively charged; and the one that controls a toner to be positively charged. Examples of the charge control agent that controls a toner to be negatively charged include monoazo metal compounds; metal acetylacetones; metal compounds of aromatic oxycarboxylic acids, aromatic dicarboxylic acids, oxycarboxylic acids, and dicarboxylic acids; aromatic oxycarboxylic acids, aromatic mono- and poly-carboxylic acids, and metal salts, anhydrides, and esters thereof; phenol derivatives such as bisphenols; urea derivatives; metal-containing salicylic acid compounds; metal-containing naphthoic acid compounds; boron compounds, quaternary ammonium salts; calixarene; and charge control resins.

Examples of the charge control agent that controls a toner to be positively charged include guanidines; imidazoles; quaternary ammonium salts such as tributylbenzylammonium-1-hydroxy-4-naphtosulfonate and tetrabutylammonium tetrafluoroborate, the analogs thereof such as onium salts (e.g., phosphonium salts), and lake pigments thereof; triphenylmethane dyes and lake pigments thereof (examples of laking agent include phosphotungstic acid, phosphomolybdic acid, phosphotungstic/molybdic acid, tannic acid, lauric acid, gallic acid, ferricyanides, and ferrocyanides); the metal salts of higher aliphatic acids; and charge control resins.

The above charge control agents may be used alone or in combination with two or more.

Among the above charge control agents, metal-containing salicylic acid compounds may be used. In particular, the metal included in the salicylic acid compounds may be aluminium or zirconium.

The amount of the charge control agent added is preferably 0.01 to 20.0 parts by mass and is more preferably 0.5 to 10.0 parts by mass relative to 100.0 parts by mass of the amount of binder resin (i.e., the total amount of the styrene acrylic resin and the block polymer).

The charge control resins may be polymers and copolymers including a sulfo group, a sulfonic acid salt group, or a sulfonic acid ester group. In particular, the polymers including a sulfo group, a sulfonic acid salt group, or a sulfonic acid ester group may include a sulfo group-containing acrylamide monomer or a sulfo group-containing methacrylamide monomer such that a copolymerization ratio of 2% by mass or more is preferably achieved and a copolymerization ratio of 5% by mass or more is more preferably achieved. The charge control resin having a glass transition temperature (Tg) of 35° C. to 90° C., a peak molecular weight (Mp) of 10,000 to 30,000, and a weight-average molecular weight (Mn) of 25,000 to 50,000 is preferably used. Using such a charge control resin imparts suitable triboelectric charge characteristics to toner particles without deteriorating the desired thermal characteristics of the toner particles. In addition, the sulfo group included in the charge control resin enhances the dispersibility of the charge control resin in the colorant dispersion and the dispersibility of the colorant in the colorant dispersion. This further enhances the tinting strength, transparency, and triboelectric charge characteristics of the toner.

Examples of the radical polymerization initiator used for polymerizing the polymerizable monomers include organic peroxide initiators and azo polymerization initiators. Examples of the organic peroxide initiators include benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butylperoxymaleic acid, bis(t-butylperoxy) isophthalate, methyl ethyl ketone peroxide, tert-butylperoxy-2-ethylhexanoate, diisopropyl peroxycarbonate, cumene hydroperoxide, 2,4-dichlorobenzoyl peroxide, and tert-butyl-peroxypivalate.

Examples of the azo polymerization initiators include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethylbutyronitrile.

A redox initiator including an oxidizing substance and a reducing substance may also be used as a polymerization initiator. Examples of the oxidizing substance include inorganic peroxides such as hydrogen peroxide and persulfates (e.g., a sodium salt, a potassium salt, and an ammonium salt); and oxidizing metal salts such as a cerium(IV) salt. Examples of the reducing substance include reducing metal salts (e.g., an iron(II) salt, a copper(I) salt, and a chromium (III) salt); ammonia; amino compounds such as lower amines (i.e., amines having about 1 to 6 carbon atoms, such as methylamine and ethylamine and hydroxylamine; reducing sulfur compounds such as sodium thiosulfate, sodium hydrosulfite, sodium hydrogen sulfite, sodium sulfite, and sodium formaldehydesulfoxylate; lower alcohols (i.e., alcohols having 1 to 6 carbon atoms); ascorbic acid and the salt thereof; and lower aldehydes (i.e., aldehydes having 1 to 6 carbon atoms).

Selection of the polymerization initiators is made in accordance with the 10-hour half-life temperatures thereof. The polymerization initiators may be used alone or in combination of two or more. The amount of the polymerization initiator used is generally, but varies depending on the targeted degree of polymerization, 0.5 to 20.0 parts by mass relative to 100.0 parts by mass of the amount of polymerizable monomers.

In order to control the degree of polymerization, publicly known chain-transfer agents and polymerization inhibitors may further be used.

Various crosslinking agents may be used for polymerizing the polymerizable monomers. Examples of the crosslinking agents include polyfunctional compounds such as divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate, and trimethylolpropane trimethacrylate.

The dispersion stabilizer included in the above-described aqueous medium may be selected from publicly known dispersion stabilizers composed of an inorganic compound or an organic compound. Examples of the inorganic compound constituting the dispersion stabilizers include tricalcium phosphate, magnesium phosphate, aluminium phosphate, zinc phosphate, calcium carbonate, magnesium carbonate, calcium hydroxide, magnesium hydroxide, aluminium hydroxide, calcium metasilicate, calcium sulfate, barium sulfate, bentonite, silica, and alumina. Examples of the organic compound constituting the dispersion stabilizers include polyvinyl alcohol, gelatin, methylcellulose, methylhydroxypropylcellulose, ethylcellulose, the sodium salt of carboxymethylcellulose, polyacrylic acid, the salt of polyacrylic acid, and starch. The amount of the dispersion stabilizer used is preferably 0.2 to 20.0 parts by mass relative to 100.0 parts by mass of the amount of polymerizable monomers.

In the case where, among the above dispersion stabilizers, a dispersion stabilizer composed of an inorganic compound is used, the dispersion stabilizer may be a commercially available one. Alternatively, the inorganic compound may be produced in an aqueous medium in order to prepare a dispersion stabilizer having a smaller particle size. For example, tricalcium phosphate can be produced by mixing an aqueous sodium phosphate solution with an aqueous calcium chloride solution while stirring is performed at a high speed.

An external additive may be deposited on the surfaces of the toner particles in order to impart various properties to the toner. Examples of the external additive used for enhancing the flowability of the toner include inorganic fine particles such as silica fine particles, titanium oxide fine particles, and silicon-titanium composite oxide fine particles. Among these inorganic fine particles, silica fine particles and titanium oxide fine particles are advantageous. For example, the inorganic fine particles are mixed with toner particles so as to be deposited on the surfaces of the toner particles. Thus, a toner is prepared. For depositing the inorganic fine particles on the surfaces of toner particles, any publicly known method may be employed. For example, a "Mitsui Henschel Mixer" produced by Mitsui Miike Machinery Co., Ltd. may be used for mixing the inorganic fine particles with toner particles.

Examples of the silica fine particles include silica particles produced by vapor-phase oxidation of a silicon halide, that is, dry-process silica particles or fumed silica particles; and silica particles produced from water glass, that is, wet-process silica particles. As inorganic fine particles, the dry-process silica particles are advantageously used, in which the content of silanol groups that are present on the surfaces of and inside the silica fine particles is low and the contents of $Na_2O$ and $SO_3^{2-}$ are low. The dry-process silica particles may be composite fine particles containing silica and another metal oxide which are produced by, in the production process, using a metal halide, such as aluminium chloride or titanium chloride, in combination with a silicon halide.

The inorganic fine particles may be subjected to a hydrophobization treatment, because making the surfaces of the inorganic fine particles to be hydrophobic with a hydrophobizing agent enables the amount of triboelectric charge on the toner particles to be controlled appropriately and enhances the environmental stability of the toner. Furthermore, the flowability of the toner in a high-temperature, high-humidity environment may also be enhanced. If the inorganic fine particles deposited on the surfaces of the toner particles absorb moisture, the amount of triboelectric charge on the toner particles may be reduced, and the flowability of the toner may be degraded. As a result, the developability and transferability of the toner are likely to be degraded.

Examples of an agent used for imparting hydrophobicity to the inorganic fine particles include an unmodified silicone varnish, various modified silicone varnishes, an unmodified silicone oil, various modified silicone oil, silanes, a silane coupling agent, other organosilicon compounds, and organotitanium compounds. In particular, a silicone oil is advantageously used. The above hydrophobizing agents may be used alone or in combination of two or more.

The total amount of the inorganic fine particles added is preferably 0.1 to 2.0 parts by mass and is more preferably 0.2 to 1.0 parts by mass relative to 100.0 parts by mass of the amount of toner particles. The particle diameter of the external additive is preferably 1/10 or less of the average diameter of the toner particles with consideration of the endurance of toner particles on which the external additive is deposited.

Methods for determining the physical properties of toner particles according to this embodiment are described below.

Method for Determining SP

In this embodiment, SP is calculated using the Fedors' formula (Formula (3)) below. The values of Δei and Δvi are determined in accordance with "Evaporation energies and molar volumes of atoms and atomic groups (25° C.)" described in Table 3-9 in "Coating no Kisokagaku", 1986, Maki-Shoten, pp. 54-57.

$$\delta i=[Ev/V]^{1/2}=[\Delta ei/\Delta vi]^{1/2} \quad (3)$$

where, Ev: Evaporation energy

V: Molar volume

Δei: The evaporation energy of the atom or atomic group of element i

Δvi: The molar volume of the atom or atomic group of element i

For example, the SP of hexanediol, which is constituted by two atomic groups —OH and six atomic groups —$CH_2$, is calculated using the following formula.

$$\delta i=[\Delta ei/\Delta vi]^{1/2}=[\{(5220)\times 2+(1180)\times 6\}/\{(13)\times 2+(16.1)\times 6\}]^{1/2}$$

Thus, the SP (δi) of hexanediol is 11.95.

Method for Determining Molecular Weight

The weight-average molecular weights (Mw) and number-average molecular weights (Mn) of the block polymer, the vinyl polymer segment, and the toner are determined by gel permeation chromatography (GPC) in the following manner. Note that the term "weight-average molecular weight" of the toner used herein refers to a weight-average molecular weight obtained by measuring a matter of the toner which is soluble in tetrahydrofuran (THF).

A specimen is dissolved in THF at room temperature. The resulting solution is filtered through a solvent-resistant membrane filter "Myshori Disc" produced by Tosoh Corporation having a pore diameter of 0.2 μm to form a sample solution. The concentration of a component soluble in THF in the sample solution is controlled to be 0.8% by mass. The sample solution is subjected to the following measurement.

Apparatus: High-speed GPC system "HLC-8220GPC" produced by Tosoh Corporation

Columns: "LF-604", two columns

Eluent: THF

Flow rate: 0.6 mL/min

Oven temperature: 40° C.

Amount of specimen injected: 0.020 mL

For calculating the molecular weight of the specimen, a molecular-weight calibration curve prepared on the basis of standard polystyrene resins (e.g., "TSK Standard Polystyrenes F-850, F-450, F-288, F-128, F-80, F-40, F-20, F-10, F-4, F-2, F-1, A-5000, A-2500, A-1000, and A-500" produced by Tosoh Corporation) is used.

Method for Determining Ratio Between Polyester Segment and Vinyl Polymer Segment in Block Polymer The ratio between the polyester segment and vinyl polymer segment that are included in the block polymer is determined by nuclear magnetic resonance spectrometric analysis ($^1$H-NMR) [400 MHz, $CDCl_3$, room temperature (25° C.)].

Apparatus: FT NMR system "JNM-EX400" produced by JEOL Ltd.

Frequency: 400 MHz

Pulse condition: 5.0 μs

Frequency range: 10,500 Hz

Number of integration: 64 times

The mass ratio (C/A) of the polyester segment to the vinyl polymer segment is determined on the basis of the integration value calculated from the observed spectrum.

Method for Measuring Melting Point

The melting point (Tm) of the block polymer is measured with a differential scanning calorimeter "Q1000" produced by TA Instruments in accordance with ASTM D3418-82.

For performing calibration of observed temperatures in a detecting unit of the apparatus, the melting points of indium and zinc are used. For performing calibration of correcting observed heat quantities, the heat of fusion of indium is used.

Specifically, 5 mg of the block polymer is precisely taken and placed on an aluminium pan. An empty aluminium pan is also prepared as a reference. The two aluminium pans are subjected to the measurement within the temperature range of 30° C. to 200° C. at the rate of temperature rise and fall of 10° C./min. In this measurement, the temperature is increased to 200° C., subsequently reduced to 30° C., and again increased. The maximum endothermic peak in the DSC curve observed in the second temperature-rise at 30° C. to 200° C. is considered to be the melting point (Tm) of the block polymer according to the embodiment which is determined by DSC.

NMR (Confirmation of Partial Structure Represented by Formula (1))

The partial structure represented by Formula (1) above, which is included in the organosilicon polymer included in the toner particles, is confirmed by solid-state NMR in the following manner. The measurement conditions and a method for preparing specimens are described below.

Measurement Conditions

Apparatus: "JNM-EX400" produced by JEOL Ltd.

Probe: 6 mm CP/MAS probe

Temperature: Room temperature

Standard substance: Polydimethylsilane (PDMS) External reference: −34.0 ppm

Measured nucleus: $^{29}$Si (resonance frequency: 79.30 MHz)

Pulse mode: CP/MAS

Pulse width: 6.4 μsec

Repetition time: ACQTM=25.6 msec, PD=15.0 sec

Data point: POINT=4096, SAMPO=1024

Contact time: 5 msec

Spectrum width: 40 kHz

Specimen rotation speed: 6 kHz

Number of integration: 2,000

Specimen: 200 mg of a specimen, which is prepared as described below, is charged into a sample tube having a diameter of 6 mm.

Preparation of specimen: 10.0 g of toner particles are precisely weighed and charged into an extraction thimble "No. 86R" produced by Toyo Roshi Kaisha, Ltd. The extraction thimble is placed in a Soxhlet extractor, and extraction is performed for 20 hours by using 200 ml of THF as a solvent. The residue in the extraction thimble is vacuum-dried at 40° C. for a few hours. The dried residue is considered to be the THF-insoluble matter of the toner particles for NMR.

In this embodiment, in the case where the organic fine powder or inorganic fine powder is deposited on the toner particles, the organic fine powder or inorganic fine powder is removed from the toner by the following method.

To 100 mL of ion-exchange water, 160 g of sucrose produced by Kishida Chemical Co., Ltd. is added and dissolved using a water bath. Thus, a heavy solution of cane sugar is prepared. The heavy solution of cane sugar (31 g) and 6 mL of "Contaminon N" produced by Wako Pure Chemical Industries, Ltd. (10 mass % aqueous solution of a neutral detergent for micrometers having a pH of 7, which contains a nonionic surfactant, an anionic surfactant, and an organic builder) are charged into a centrifugal separation tube in order to prepare a dispersion solution. To the dispersion liquid, 1.0 g of the toner is added. Blocks of toner are broken into small pieces with a spatula or the like.

The centrifugal separation tube is shaken with a shaker at 350 strokes per minute (spm) for 20 minutes. Subsequently, the solution is charged into a swing-rotor glass tube (50 mL) and subjected to a centrifugal separator at 3,500 rpm for 30 minutes. This operation enables the external additive detached from the toner particles to be removed. After it has been visually confirmed that the toner is separated from the aqueous solution to a sufficient degree, the separated toner contained in the uppermost layer is taken with a spatula or the like. The toner is filtered through a vacuum filter and subsequently dried with a drying machine for 1 hour or more to form sample toner particles. The above operation is repeated a plurality of times until a predetermined amount of toner particles is produced.

The sample toner particles, which are the THF-insoluble matter of the toner particles, are measured by NMR in the above-described manner. The resulting NMR spectrum that contains information regarding a plurality of silane components of the toner particles which have different substituent groups and linkage groups are separated into peaks corresponding to the Q1, Q2, Q3, and Q4 structures described below by curve fitting. The molar proportions of the components having the Q1, Q2, Q3, and Q4 structures are calculated from the area proportions of the respective peaks.

For performing curve-fitting, a software for JNM-EX400, "EXcalibur for Windows version 4.2 (EX series)" produced by JEOL Ltd. is used. Specifically, "1D Pro" in the menu icons is selected to load the measured data.

Figure 2:
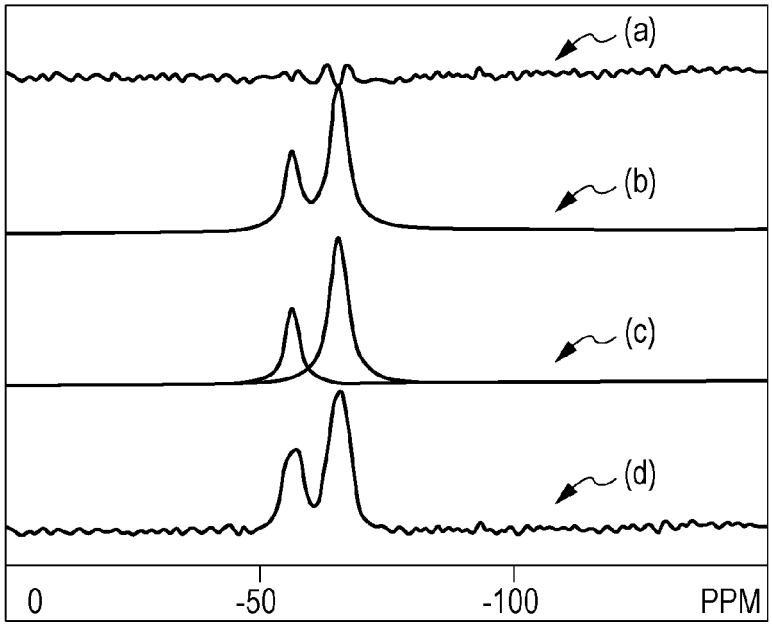
FIG. 2 illustrates an example NMR spectrum of an organosilicon compound according to an embodiment.

Then, "Curve fitting function" in the menu bar "Command" is selected to perform curve-fitting. FIG. 2 illustrates an example of the results of NMR. Peak separation is performed such that the peak of composite peak difference (a), which is the difference between the composite peaks (b) and the measured spectrum (d), is minimized.

The areas of the peak corresponding to the Q1 structure, the peak corresponding to the Q2 structure, the peak corresponding to the Q3 structure, and the peak corresponding to the Q4 structure are calculated. Then, SQ1, SQ2, SQ3, and SQ4 are calculated from the above areas by using the following formulas.

Q1 structure: $(R^i)(R^j)(R^k)SiO_{1/2}$ (4)

Q2 structure: $(R^g)(R^h)Si(O_{1/2})_2$ (5)

Q3 structure: $R^fSi(O_{1/2})_3$ (6)

Q4 structure: $Si(O_{1/2})_4$ (7)

Q1:

(4)

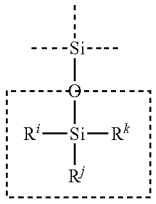

Q2:

(5)

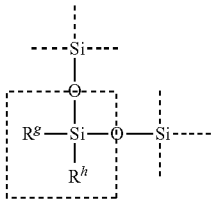

Q3:

(6)

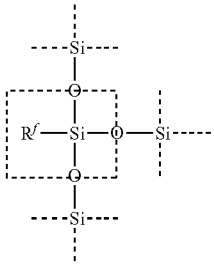

-continued

Q4:

(7)

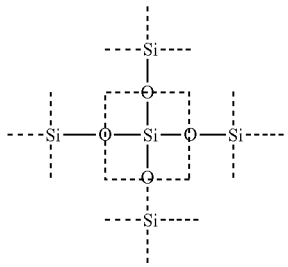

where $R^f$, $R^g$, $R^h$, $R^i$, $R^j$, and $R^k$ represent an organic group, a halogen atom, a hydroxyl group, or an alkoxy group bonded to the silicon atom.

In this embodiment, identification of silane monomers is done on the basis of the chemical shift value thereof, and the total area of the peak corresponding to the Q1 structure, the peak corresponding to the Q2 structure, the peak corresponding to the Q3 structure, and the peak corresponding to the Q4 structure, which are determined from the $^{29}$Si-NMR measurement of the toner particles, is considered to be the total area of the peaks corresponding to the organosilicon polymer.

SQ1+SQ2+SQ3+SQ4=1.000

SQ1={Area of Q1/(Area of Q1+Area of Q2+Area of Q3+Area of Q4)}

SQ2={Area of Q2/(Area of Q1+Area of Q2+Area of Q3+Area of Q4)}

SQ3={Area of Q3/(Area of Q1+Area of Q2+Area of Q3+Area of Q4)}

SQ4={Area of Q4/(Area of Q1+Area of Q2+Area of Q3+Area of Q4)}

Thus, SQ3 is the ratio of the peak area corresponding to the partial structure represented by Formula (1) to the total peak area corresponding to the organosilicon polymer according to the embodiment.

The chemical shift values of silicon atoms included in the Q1 structure, Q2 structure, Q3 structure, and Q4 structure are as follows.

An example of the Q1 structure ($R^i$=$R^j$=—$OC_2H_5$, $R^k$=—$CH_3$): −47 ppm

An example of the Q2 structure ($R^g$=—$OC_2H_5$, $R^h$=—$CH_3$): −56 ppm

An example of the Q3 structure ($R^f$=—$CH^3$): −65 ppm

Q4 structure: −108 ppm

Method for Confirming Partial Structure Represented by Formula (1)

The presence of the organic group represented by Rf in Formula (1) is confirmed by $^{13}$C-NMR.

The detailed structure of Formula (1) is confirmed by $^1$H-NMR, $^{13}$C-NMR, and $^{29}$Si-NMR. The apparatus used in the measurements and the measurement conditions are described below.

Measurement Conditions

Apparatus: "AVANCE III 500" produced by BRUKER

Probe: 4 mm MAS BB/1H

Temperature: Room temperature

Specimen rotation speed: 6 kHz

Specimen: 150 mg of a specimen to be measured (the THF-insoluble matter of the toner particles for NMR measurement) is charged into a sample tube having a diameter of 4 mm.

The presence of the organic group represented by Rf in Formula (1) is confirmed by the following method. When a signal is observed, the structure represented by Formula (1) is considered to be "present".

$^{13}$C-NMR (solid) measurement conditions

Nucleus frequency: 125.77 MHz

Standard substance: Glycine (external standard: 176.03 ppm)

Observation width: 37.88 kHz

Measurement method: CP/MAS

Contact time: 1.75 ms

Repetition time: 4 s

Number of integration: 2,048

LB value: 50 Hz

Method for Determining Average Thickness (Dav.) of Surface Layers of Toner Particles from Results of Observation of Cross Sections of the Toner Particles with TEM In this embodiment, the observation of the cross sections of the toner particles is done by the following method.

The toner particles are dispersed in a cold-setting epoxy resin. The resulting epoxy resin is left to stand in an atmosphere of 40° C. for 2 days so as to be cured. A thin sample is taken from the cured epoxy resin with a microtome including a diamond blade. This sample is observed with a TEM "Tecnai TF20XT" produced by FEI with a magnification of 10 thousand power to 100 thousand power in order to observe the cross sections of the toner particles.

In this embodiment, the surface layers of the toner particles are confirmed taking advantage of the fact that the atomic weight of atoms included in the resins used and the atomic weight of atoms included in the organosilicon polymer are different from each other and the heavier the atomic weight, the higher the contrast in the TEM image. For increasing the contrast between different materials, a ruthenium tetroxide staining methods and an osmium tetroxide staining method may be used. In this embodiment, a vacuum electron staining machine "VSC4R1H" produced by Filgen is used. The thin sample is charged into a chamber and stained at a density of 5 for a staining time of 15 minutes.

The toner particles used in the measurement of Dav. are toner particles having an equivalent circle diameter Dtem, which is determined from the cross sections of the toner particles in the TEM image, that falls within the range of ±10% of the weight-average particle diameter of the toner particles, which is determined by the following method.

As described above, a bright-field image of the cross sections of the toner particles is captured with a TEM "Tecnai TF20XT" produced by FEI at an acceleration voltage of 200 kV. An EF mapping image at the Si—K end (99 eV) is captured by a three-window method with an EELS detector "GIF Tridiem" produced by Gatan in order to confirm the presence of the organosilicon polymer on the surface layers. Subsequently, a cross section of a toner particle having an equivalent circle diameter Dtem that falls within the range of ±10% of the weight-average particle diameter of the toner particle is divided into 16 equal sections by using, as a center, the midpoint of the major axis L that gives the maximum diameter of the cross section of the toner particle. Specifically, 16 straight lines are drawn across the cross section so as to pass through the midpoint of the major axis L such that each adjacent pair of the straight lines intersect at the midpoint at the same relative angle) (11.25° in order to form 32 line segments connecting the midpoint and the surface of the toner particle. Hereinafter, the line segments (i.e., parting axes) that extend from the center toward the surface layer of the toner particle are denoted by $Ar_n$ (n=1 to 32); the lengths of the line segments (i.e., parting axes) are denoted by $Ar_n$ (n=1 to 32); and the thicknesses of the surface layer which are measured on the line segments $Ar_n$ are denoted by $FRA_n$ (n=1 to 32). The average Dav. of the thicknesses of the surface layer of the toner particle, the surface layer including the organosilicon polymer, at the 32 points on the respective parting axes is determined. In this embodiment, the average thicknesses Dav. of 10 toner particles are calculated, and the arithmetic average thereof is obtained.

The circle-equivalent diameter (Dtem) of the toner particles which is determined from the cross sections of the toner particles in the TEM image is double the arithmetic average of $Ar_n$ (n=1 to 32).

[Circle-Equivalent Diameter (Dtem) of Toner Particles Determined from Cross Sections of The Toner Particles in TEM Image]$=(Ar_1+Ar_2+Ar_3+Ar_4+Ar_5+Ar_6+Ar_7+Ar_8+Ar_9+Ar_{10}+Ar_{11}+Ar_{12}+Ar_{13}+Ar_{14}+A_{15}+Ar_{16}+Ar_{17}+Ar_{18}+Ar_{19}+Ar_{20}+Ar_{21}+Ar_{22}+Ar_{23}+Ar_{24}+Ar_{25}+Ar_{26}+Ar_{27}+Ar_{28}+Ar_{29}+Ar_{30}+Ar_{31}+Ar_{32})/16$ The average thickness (Dav.) of the surface layers of the toner particles is determined by the following method. The average thickness $D_{(n)}$ of the surface layer of a toner particle is determined by the following method.

$D_{(n)}$=(Total of Thicknesses of Surface Layer Measured at 32 Positions on Respective Parting Axes)/32$=(FRA_1+FRA_2+FRA_3+FRA_4+FRA_5+FRA_6+FRA_7+FRA_8+FRA_9+FRA_{10}+FRA_{11}+FRA_{12}+FRA_{13}+FRA_{14}+FRA_{15}+FRA_{16}+FRA_{17}+FRA_{18}+FRA_{19}+FRA_{20}+FRA_{21}+FRA_{22}+FRA_{23}+FRA_{24}+FRA_{25}+FRA_{26}+FRA_{27}+FRA_{28}+FRA_{29}+FRA_{30}+FRA_{31}+FRA_{32})/32$ The average thicknesses $D_{(n)}$(n=1 to 10) of 10 toner particles and the average thereof are calculated. This is considered to be the average thickness (Dav.) of the toner particles.

Measurement of Content of Organosilicon Polymer

The content of the organosilicon polymer is measured with a wavelength-dispersive X-ray fluorescence analyzer "Axios" produced by PANalytical and the supplied exclusive software "SuperQ ver.4.0F" produced by PANalytical which is used for setting the measurement conditions and analyzing the measurement data. The measurement is conducted with an anode of the X-ray tube being Rh in a vacuum atmosphere at a measurement diameter (i.e., the diameter of collimator mask) of 27 mm for 10 seconds. For measuring light elements, a proportional counter (PC) is used. For measuring heavy elements, a scintillation counter (SC) is used.

The sample used in the measurement is a pellet formed by charging 4 g of the toner particles into an exclusive aluminium ring for pressing, levelling the surface of the toner, and compressing the toner with a pellet-forming compressor "BRE-32" produced by MAEKAWA TESTING MACHINE MFG. Co., Ltd. at 20 MPa for 60 seconds into a shape having a thickness of 2 mm and a diameter of 39 mm.

A silica ($SiO_2$) fine powder is added to sample toner particles that do not include the organosilicon polymer such that the amount of silica fine powder is 0.10 parts by mass relative to 100 parts by mass of the amount of toner particles. The silica fine powder is mixed with the toner particles to a sufficient degree with a coffee mill. In the same manner, a silica ($SiO_2$) fine powder is added to two sets of sample toner particles that do not include the organosilicon polymer such that the amounts of silica fine powder are 0.20 parts by mass and 0.50 parts by mass, respectively, relative to 100 parts by mass of the amount of organosilicon polymer. The three sets of sample toner particles are used as specimens for preparing a calibration curve.

Each of the specimens is formed into a pellet used for preparing a calibration curve by using the pellet-forming compressor in the above-described manner. The counting rate (unit: cps) of the Si-Kα radiation observed at a diffraction angle (2θ) of 109.08° when each of the pellets is used as a dispersive crystal is measured. The acceleration voltage and current of the X-ray generator used in the measurement are 24 kV and 100 mA, respectively. Thus, a linear calibration curve in which the vertical axis shows the counting rate of the X-ray and the horizontal axis shows the amount of $SiO_2$ added to each of the specimens used for preparing the calibration curve is prepared.

Subsequently, the toner particles to be analyzed is formed into pellets with the pellet-forming compressor in the above-described manner. The counting rate of the Si-Kα radiation which is measured when the pellet is used as a dispersive crystal is measured. Then, the content of the organosilicon polymer in the toner particles is determined on the basis of the calibration curve.

Ratio (Atomic %) of Silicon Atoms on Surfaces of Toner Particles

The intensity corresponding to silicon atoms [dSi], the intensity corresponding to carbon atoms [dC], the intensity corresponding to oxygen atoms [dO], and the intensity corresponding to sulfur atoms [dS] on the surfaces of the toner particles are calculated by analyzing the composition of the surfaces of the toner particles by X-ray photoelectron spectroscopy (ESCA). The apparatus used in ESCA and the ESCA conditions are described below.

Apparatus: "Quantum2000" produced by ULVAC-PHI
X-ray Photoelectron Spectroscopy Conditions
X-ray source: AlKα
X-ray: 100 μm, 25 W, 15 kV
Raster: 300 μm×200 μm
Pass energy: 58.70 eV
Step size: 0.125 eV
Neutralization electron gun: 20 μA, 1 V
Ar-ion gun: 7 mA, 10 V
Number of sweep: Si: 15, C: 10, O: 10, S: 5

The dSi, dC, do, and dS (all in atomic %) on the surfaces of the toner particles are each calculated from the peak intensity corresponding to the element by using relative sensitivity factors provided by PHI.

Method for Determining Weight-Average Diameter (D4) of Toner Particles

The weight-average diameter (D4) of the toner particles is determined by measuring the toner particles in accordance with an aperture impedance method with a precise particle-size distribution measuring apparatus "Multisizer 3 COULTER COUNTER" produced by Beckman Coulter, Inc. equipped with a 100-μm aperture tube and the supplied exclusive software "Beckman Coulter, Inc. Multisizer 3, Version 3.51" produced by Beckman Coulter, Inc., which is used for setting the measurement conditions and analyzing the measured data, at the number of effective measuring channels of 25,000 and analyzing the measured data. The measurement method is the same as the method described in Japanese Patent Laid-Open No. 2014-130238.

EXAMPLES

The foregoing embodiment is described further in detail with reference to Examples below. However, the present invention is not limited to Examples below. In Examples and Comparative examples below, "parts" and "%" are all on a mass basis unless otherwise specified.

Block polymers used in Examples are described below.

Preparation of Block Polymer 1

To a reaction container equipped with a stirrer, a thermometer, a nitrogen-introduction tube, a dewatering tube, and a decompressor, 100.0 parts of sebacic acid and 105.5 parts of 1,12-dodecanediol were added. The resulting mixture was heated to 130° C. while being stirred. After 0.3 parts of titanium(IV) isopropoxide that served as an esterification catalyst had been added to the mixture, the mixture was heated to 160° C. and condensation polymerization was performed for 5 hours. Subsequently, the mixture was heated to 180° C., and the reaction was continued until a desired molecular weight was achieved while the pressure inside the reaction container was reduced. Thus, a polyester (1) was prepared. The polyester (1) had a weight-average molecular weight (Mw) of 17,000 and a melting point (Tm) of 83° C.

To a reaction container equipped with a stirrer, a thermometer, and a nitrogen-introduction tube, 100.0 parts of the polyester (1) and 440.0 parts of dehydrated chloroform were added. After the polyester (1) had been completely dissolved in the dehydrated chloroform, 5.0 parts of triethylamine was added to the resulting solution. Subsequently, 15.0 parts of 2-bromoisobutyryl bromide was gradually added to the reaction container while the reaction container was cooled with ice. The resulting mixture was stirred at room temperature (25° C.) for a whole day.

To a container containing 550.0 parts of methanol, the resulting resin solution was gradually added dropwise in order to reprecipitate a resin component of the resin solution. The precipitate was filtered, purified, and dried to form a polyester (2).

To a reaction container equipped with a stirrer, a thermometer, and a nitrogen-introduction tube, 100.0 parts of the polyester (2), 120.0 parts of styrene, 3.0 parts of copper (I) bromide, and 6.5 parts of pentamethyldiethylenetriamine were added. The resulting mixture was polymerized at 110° C. while being stirred. When a desired molecular weight was achieved, the reaction was stopped and the reaction solution was again subjected to precipitation. The precipitate was filtered and purified with 250.0 parts of methanol in order to remove unreacted styrene and the catalyst. Subsequently, drying was performed with a vacuum dying machine maintained at 50° C. Thus, a block polymer 1 having a polyester segment C and a vinyl polymer segment A was prepared. Table 3 summarizes the physical properties of the block polymer 1.

Preparation of Block Polymers 2 to 5

Block polymers 2 to 5 were prepared as in the preparation of the block polymer 1, except that the conditions under which the block polymers 2 to 5 were prepared were changed as described in Table 1. Table 3 summarizes the physical properties of the block polymers 2 to 5.

Preparation of Block Polymer 6

In a reaction container equipped with a stirrer, a thermometer, a nitrogen-introduction tube, and a decompressor, 100.0 parts of xylene was heated to reflux at 120° C. while the reaction container was purged with nitrogen. To the reaction container, a mixture of 100.0 parts of styrene and 9.0 parts of dimethyl 2,2'-azobis(2-methylpropionate) was added dropwise over 3 hours. After the addition of the mixture had been completed, the resulting solution was stirred for 3 hours. Subsequently, distillation was performed at 160° C. and 1 hPa in order to remove xylene and remaining styrene. Thus, a vinyl polymer (1) was prepared.

To a reaction container equipped with a stirrer, a thermometer, a nitrogen-introduction tube, a dewatering tube, and a decompressor, 100.0 parts of the vinyl polymer (1), 80.0 parts of xylene that served as an organic solvent, 109.8 parts of 1,12-dodecanediol, and 0.7 parts of titanium(IV) isopropoxide that served as an esterification catalyst were added. The resulting mixture was reacted at 150° C. for 4 hours in a nitrogen atmosphere. Subsequently, 105.5 parts of sebacic acid was added to the reaction container. The reaction was continued for another 3 hours at 150° C. and for another 4 hours at 180° C. The reaction was further continued at 180° C. and 1 hPa until a desired Mw was achieved. Thus, a block polymer 6 was prepared. Table 3 summarizes the physical properties of the block polymer 6.

Preparation of Block Polymers 7 to 16

Block polymers 7 to 16 were prepared as in the preparation of the block polymer 6, except that the conditions under which the block polymers 7 to 16 were prepared were changed as described in Table 2. Table 3 summarizes the physical properties of the block polymers 7 to 16.

TABLE 1

| | Polyester segment C | | | | Vinyl polymer segment A (relative to 100 parts of polyester) | | | |
|---|---|---|---|---|---|---|---|---|
| | Acid | Amount (mass part) | Alcohol | Amount (mass part) | Vinyl monomer | Amount (mass part) | Vinyl monomer | Amount (mass part) |
| Block Polymer 1 | Sebacic acid | 100.0 | 1,12-Dodecanediol | 105.5 | Styrene | 120.0 | — | — |
| Block Polymer 2 | Tetradecanedioic acid | 100.0 | 1,12-Dodecanediol | 84.0 | Styrene | 300.0 | — | — |
| Block Polymer 3 | Suberic acid | 100.0 | 1,7-Heptanediol | 80.0 | Styrene | 300.0 | — | — |
| Block Polymer 4 | Sebacic acid | 100.0 | 1,12-Dodecanediol | 105.5 | MMA | 102.0 | t-BA | 18.0 |
| Block Polymer 5 | Sebacic acid | 100.0 | 1,9-Nonanediol | 105.5 | Styrene | 82.8 | i-BA | 37.2 |

TABLE 2

| | Polyester segment C (relative to 100 parts of vinyl monomer) | | | | Vinyl polymer segment A | | | |
|---|---|---|---|---|---|---|---|---|
| | Acid | Amount (mass part) | Alcohol | Amount (mass part) | Vinyl monomer | Amount (mass part) | Amount of initiator | Reaction temperature (° C.) |
| Block Polymer 6 | Dodecanedioic acid | 105.5 | 1,12-Dodecanediol | 109.8 | Styrene | 100.0 | 9.0 | 120 |
| Block Polymer 7 | Dodecanedioic acid | 143.2 | 1,10-Decanediol | 127.8 | Styrene | 100.0 | 9.0 | 120 |
| Block Polymer 8 | Sebacic acid | 81.9 | 1,6-Hexanediol | 57.2 | Styrene | 100.0 | 9.0 | 120 |
| Block Polymer 9 | Sebacic acid | 125.3 | 1,12-Dodecanediol | 125.3 | Styrene | 100.0 | 5.0 | 120 |
| Block Polymer 10 | Sebacic acid | 125.3 | 1,12-Dodecanediol | 145.4 | Styrene | 100.0 | 6.0 | 120 |
| Block Polymer 11 | Sebacic acid | 125.3 | 1,12-Dodecanediol | 145.4 | Styrene | 100.0 | 13.5 | 120 |
| Block Polymer 12 | Sebacic acid | 125.3 | 1,12-Dodecanediol | 125.3 | Styrene | 100.0 | 13.5 | 140 |
| Block Polymer 13 | Sebacic acid | 175.5 | 1,12-Dodecanediol | 194.3 | Styrene | 100.0 | 9.0 | 120 |
| Block Polymer 14 | Sebacic acid | 21.7 | 1,12-Dodecanediol | 37.2 | Styrene | 100.0 | 9.0 | 120 |
| Block Polymer 15 | Sebacic acid | 14.1 | 1,12-Dodecanediol | 28.3 | Styrene | 100.0 | 9.0 | 120 |
| Block Polymer 16 | Sebacic acid | 230.8 | 1,12-Dodecanediol | 249.9 | Styrene | 100.0 | 9.0 | 120 |

TABLE 3

| | Physical properties | | | |
|---|---|---|---|---|
| | Mw | C/A ratio | Tm | SP |
| Block Polymer 1 | 25,000 | 70/30 | 78 | 9.59 |
| Block Polymer 2 | 33,000 | 50/50 | 90 | 9.58 |
| Block Polymer 3 | 34,000 | 55/45 | 62 | 9.85 |
| Block Polymer 4 | 25,000 | 75/25 | 78 | 9.57 |
| Block Polymer 5 | 25,000 | 75/25 | 72 | 9.76 |
| Block Polymer 6 | 25,000 | 70/30 | 85 | 9.54 |
| Block Polymer 7 | 25,000 | 75/25 | 75 | 9.56 |
| Block Polymer 8 | 25,000 | 60/40 | 65 | 9.79 |
| Block Polymer 9 | 48,000 | 75/25 | 79 | 9.57 |
| Block Polymer 10 | 45,000 | 75/25 | 78 | 9.57 |
| Block Polymer 11 | 15,000 | 75/25 | 76 | 9.57 |
| Block Polymer 12 | 13,500 | 75/25 | 75 | 9.57 |
| Block Polymer 13 | 25,000 | 80/20 | 80 | 9.55 |
| Block Polymer 14 | 25,000 | 40/60 | 74 | 9.69 |
| Block Polymer 15 | 25,000 | 35/65 | 72 | 9.70 |
| Block Polymer 16 | 25,000 | 85/15 | 80 | 9.54 |

Preparation of Negative-Charge Control Resin 1

To a pressurizable reaction container equipped with a reflux tube, a stirrer, a thermometer, a nitrogen-introduction tube, a dropping device, and a decompressor, 255.0 parts of methanol, 145.0 parts of 2-butanone, and 100.0 parts of 2-propanol were added as solvents, and 88.0 parts of styrene, 6.0 parts of 2-ethylhexyl acrylate, and 5.0 parts of 2-acrylamide-2-methylpropanesulfonic acid were added as polymerizable monomers. The resulting mixture was heated to the reflux temperature while being stirred. A solution prepared by diluting 1.0 parts of 2,2'-azobisisobutyronitrile that served as a polymerization initiator with 20.0 parts of 2-butanone was added dropwise to the mixture over 30 minutes, and stirring of the mixture was continued for another 5 hours. A solution prepared by diluting 1.2 parts of 2,2'-azobisisobutyronitrile with 20 parts by mass of 2-butanone was further added dropwise to the mixture over 30 minutes. After the mixture had been stirred for another 5 hours, the polymerization reaction was terminated. Thus, an aggregate was formed.

The polymerization solvent was distilled away under a reduced pressure in order to obtain the aggregate. The aggregate was crushed into coarse particles having a diameter of 100 μm or less with a cutter mill equipped with a 150-mesh screen (opening size: 104 μm). The coarse particles were pulverized into fine particles with a jet mill. The resulting fine powder was classified through a 250-mesh sieve (opening size: 61 μm) in order to separate particles having a diameter of 60 μm or less. The particles were dissolved in methyl ethyl ketone (MEK) such that the concentration of the particles in MEK was 10%. The resulting solution was gradually added to an amount of methanol 20 times the amount of MEK in order to perform reprecipitation. The resulting precipitate was washed in an amount of methanol corresponding to half the amount of methanol used for reprecipitation and then filtered. The filtered particles were vacuum dried at 35° C. for 48 times.

The vacuum-dried particles were again dissolved in MEK such that the concentration of the particles in MEK was 10%, and the resulting solution was gradually added to an amount of n-hexane 20 times the amount of MEK in order to perform reprecipitation. The resulting precipitate was washed in an amount of n-hexane corresponding to half the amount of n-hexane used for reprecipitation and then filtered. The filtered particles were vacuum-dried at 35° C. for 48 hours. Thus, a polar polymer was prepared. The polar polymer had a glass transition temperature (Tg) of 83° C., a main peak molecular weight (Mp) of 21,500, a number-average molecular weight (Mn) of 11,000, a weight-average molecular weight (Mw) of 33,000, and an acid value of 14.5 mgKOH/g. The composition of the polar polymer which was determined by $^{1}$H-NMR with "EX-400" produced by JEOL Ltd. (400 MHz) was, by mass, styrene:2-ethylhexyl acrylate:2-acrylamide-2-methylpropanesulfonic acid=88.0:6.0:5.0. Hereinafter, the polar polymer is referred to as a "negative-charge control resin 1".

Preparation of Toner 1

To 1300.0 parts of ion-exchange water heated to 60° C., 9.0 parts of tricalcium phosphate was added. The resulting mixture was stirred with a "T.K. Homo Mixer" produced by PRIMIX Corporation at an agitation speed of 15,000 rpm to form an aqueous medium.

The following components were mixed together while being stirred with a propeller stirring machine at an agitation speed of 100 rpm to form a liquid mixture.

Styrene: 70.2 parts n-Butyl acrylate: 19.8 parts

Block polymer 1: 10.0 parts

Methyltriethoxysilane: 5.0 parts

The following components were added to the liquid mixture.

Cyan colorant (C.I. Pigment Blue 15:3): 6.5 parts

Negative-charge control agent "BONTRON E-84" produced by Orient Chemical Industries Co., Ltd.: 0.5 parts Hydrocarbon wax (Tm: 78° C.): 9.0 parts Negative-charge control resin 1: 0.7 parts Polar resin: 5.0 parts (styrene-2-hydroxyethyl methacrylate-methacrylic acid-methyl methacrylate copolymer, acid value: 10 mgKOH/g, Tg: 80° C., Mw: 15,000)

The liquid mixture was heated to 65° C. and subsequently stirred with a "T.K. Homo Mixer" at an agitation speed of 10,000 rpm in order to dissolve or disperse the components. Thus, a polymerizable monomer composition was prepared.

The polymerizable monomer composition was added to the aqueous medium prepared above. To the resulting mixture, the following polymerization initiator was added.

"PERBUTYL PV" (10-hour half-life temperature: 54.6° C., produced by NOF CORPORATION): 9.0 parts The mixture was stirred at 60° C. with a "T.K. Homo Mixer" at an agitation speed of 15,000 rpm for 20 minutes in order to perform granulation.

Reaction-1 Step

The mixture was transferred to a propeller stirring machine. While the mixture was stirred at an agitation speed of 200 rpm, the polymerizable monomers included in the polymerizable monomer composition, that is, styrene and n-butyl acrylate, were polymerized at 70° C. for 4 hours. The pH of the mixture was 5.1.

Reaction-2 Step

To the mixture, a 1.0-mol/L aqueous NaOH solution was added such that the pH of the mixture reached 8.0. Subsequently, the temperature inside the container was increased to 90° C. and maintained at 90° C. for 1.5 hours.

Distillation Step

After the reaction-2 step had been terminated, the reflux tube was detached from the container, and a distillation device capable of collecting the fraction of distillate was attached to the container. Subsequently, the temperature inside the container (i.e., distillation temperature) was increased to 100° C. and maintained at 100° C. for 5.0 hours (i.e., distillation time). In this step, the remaining monomers, solvents, and the like were removed. The pHs of samples taken from the contents of the container at the start and end of the distillation step were both 8.0 at 85° C.

Washing Step

After the distillation step had been terminated, the temperature was reduced to 30° C., and dilute hydrochloric acid was added to the container in order to reduce the pH of the contents to 1.5. Subsequently, a dispersion stabilizer was dissolved in the contents. The contents were filtered, washed, and dried to form a toner 1 having a weight-average particle diameter of 5.6 μm.

The results of silicon mapping based on TEM images of the toner 1 confirmed that silicon atoms were present uniformly in the entire surface layers of the toner particles and the surface layers were not cover layers constituted by silicon-compound-containing granular clusters adhering to one another. Table 5 summarizes the physical properties of the toner 1.

Preparation of Toners 2 to 31 and 33 to 36

Toners 2 to 31 and 33 to 36 were produced as in the preparation of the toner 1, except that the preparation conditions and the components described in Table 4 were employed. Table 5 summarizes the physical properties of the toners 2 to 31 and 33 to 36. In the case where reduced-pressure distillation is performed, a decompressor was attached to a vacant opening of the container and the pressure inside the container was reduced to a level at which the decompressor was not drawn toward the distillation device that collects the fraction of distillate.

The results of silicon mapping based on TEM images of the above toners confirmed that, in the toners 2 to 31 and 33 to 36, silicon atoms were present uniformly in the entire surface layers of the toner particles and the surface layers were not cover layers constituted by silicon-compound-containing granular clusters adhering to one another. It was also confirmed that, in the toners 30 and 31, the amount of silicon atoms present in the surface layers of the toner particles was small.

Preparation of Toner 32

The following materials were mixed together and dispersed with an Attritor produced by Mitsui Miike Machinery Co., Ltd. for 3 hours to form a colorant dispersion liquid.

Styrene-acrylic resin: 90.0 parts (styrene-n-butyl acrylate copolymer, mass ratio of styrene:n-butyl acrylate=78:22, Mw: 30,000, Tg: 55° C.)

Block polymer 2: 10.0 parts

Methyl ethyl ketone: 100.0 parts

Ethyl acetate: 100.0 parts

Hydrocarbon wax (Tm: 78° C.): 9.0 parts

Cyan colorant (C.I. Pigment Blue 15:3): 6.5 parts

Negative-charge control resin 1: 1.0 parts

Methyltriethoxysilane: 5.0 parts

To 3000.0 parts of ion-exchange water heated to 60° C., 27.0 parts of calcium phosphate was added. The resulting mixture was stirred with a "T.K. Homo Mixer" at an agitation speed of 10,000 rpm to form an aqueous medium. The above colorant dispersion liquid was added to the aqueous medium, which was subsequently stirred at 65° C. in a nitrogen atmosphere with a "T.K. Homo Mixer" at an agitation speed of 12,000 rpm for 15 minutes to form colorant particles. Subsequently, the stirrer was changed from a "T.K. Homo Mixer" to a common propeller stirring machine, and the agitation speed of the stirring machine was maintained at 150 rpm. To the container, a 1.0-mol/L aqueous NaOH solution was added in order to control the pH of the contents to be 8.0. Subsequently, the temperature inside the container was increased to 90° C. and maintained at 90° C. for 1.5 hours.

The reflux tube was detached from the container, and a distillation device capable of collecting the fraction of distillate was attached to the container. Subsequently, the temperature inside the container was increased to 100° C. and maintained at 100° C. for 5.0 hours. The pHs of samples taken from the contents of the container at the start and end of the distillation step were both 8.0 at 85° C. After the distillation step had been terminated, the temperature was reduced to 30° C., and dilute hydrochloric acid was added to the container in order to reduce the pH of the contents to 1.5. Subsequently, calcium phosphate was dissolved in the contents. The contents were filtered, washed, and dried to form a toner 32 having a weight-average particle diameter of 5.8 μm.

The results of silicon mapping based on TEM images of the toner 32 confirmed that silicon atoms were present uniformly in the entire surface layers of the toner particles and the surface layers were not cover layers constituted by silicon-compound-containing granular clusters adhering to one another. Table 5 summarizes the physical properties of the toner 32.

TABLE 4

| | Binder resin | | | | Organosilicon polymer | | Reaction 2 Reaction |
|---|---|---|---|---|---|---|---|
| | Block polymer | Amount (mass part) | Styrene acrylic resin | Amount (mass part) | Monomer | Amount (mass part) | temperature (° C.) |
| Toner 1 | Block polymer 1 | 10 | Styrene:n-butyl acrylate 78:22 | 90 | Methyltriethoxysilane | 5 | 90 |
| Toner 2 | Block polymer 1 | 10 | Styrene:n-butyl acrylate 78:22 | 90 | Phenyltriethoxysilane | 5 | 90 |
| Toner 3 | Block polymer 1 | 10 | Styrene:n-butyl acrylate 78:22 | 90 | Ethyltriethoxysilane | 5 | 90 |
| Toner 4 | Block polymer 1 | 10 | Styrene:n-butyl acrylate 78:22 | 90 | Hexyltriethoxysilane | 5 | 90 |
| Toner 5 | Block polymer 1 | 10 | Styrene:n-butyl acrylate 78:22 | 90 | Butyltriethoxysilane | 5 | 90 |
| Toner 6 | Block polymer 1 | 10 | Styrene:n-butyl acrylate 78:22 | 90 | Methyltriethoxysilane | 20 | 90 |
| Toner 7 | Block polymer 1 | 10 | Styrene:n-butyl acrylate 78:22 | 90 | Methyltriethoxysilane | 15 | 90 |
| Toner 8 | Block polymer 1 | 10 | Styrene:n-butyl acrylate 78:22 | 90 | Methyltriethoxysilane | 2 | 90 |
| Toner 9 | Block polymer 1 | 10 | Styrene:n-butyl acrylate 78:22 | 90 | Methyltriethoxysilane | 1 | 90 |
| Toner 10 | Block polymer 1 | 10 | Styrene:n-butyl acrylate 78:22 | 90 | Ethyltriethoxysilane | 5 | 80 |
| Toner 11 | Block polymer 1 | 10 | Styrene:n-butyl acrylate 78:22 | 90 | Ethyltriethoxysilane | 5 | 85 |
| Toner 12 | Block polymer 1 | 10 | Styrene:n-butyl acrylate 78:22 | 90 | Ethyltriethoxysilane | 5 | 90 |
| Toner 13 | Block polymer 1 | 5 | Styrene:n-butyl acrylate 78:22 | 95 | Methyltriethoxysilane | 5 | 90 |
| Toner 14 | Block polymer 1 | 2 | Styrene:n-butyl acrylate 78:22 | 98 | Methyltriethoxysilane | 5 | 90 |
| Toner 15 | Block polymer 1 | 35 | Styrene:n-butyl acrylate 78:22 | 65 | Methyltriethoxysilane | 5 | 90 |
| Toner 16 | Block polymer 1 | 2 | Styrene:n-butyl acrylate 78:22 | 98 | Methyltriethoxysilane | 2 | 90 |
| Toner 17 | Block polymer 1 | 35 | Styrene:n-butyl acrylate 78:22 | 65 | Methyltriethoxysilane | 7 | 90 |
| Toner 18 | Block polymer 1 | 5 | Styrene:n-butyl acrylate 78:22 | 95 | Methyltriethoxysilane | 11 | 90 |
| Toner 19 | Block polymer 2 | 10 | Styrene:n-butyl acrylate 78:22 | 90 | Methyltriethoxysilane | 5 | 90 |
| Toner 20 | Block polymer 3 | 10 | Styrene:n-butyl acrylate 78:22 | 90 | Methyltriethoxysilane | 5 | 90 |
| Toner 21 | Block polymer 4 | 10 | Styrene:n-butyl acrylate 78:22 | 90 | Methyltriethoxysilane | 5 | 90 |
| Toner 22 | Block polymer 5 | 10 | Styrene:n-butyl acrylate 78:22 | 90 | Methyltriethoxysilane | 5 | 90 |
| Toner 23 | Block polymer 6 | 10 | Styrene:n-butyl acrylate 78:22 | 90 | Methyltriethoxysilane | 5 | 90 |
| Toner 24 | Block polymer 7 | 10 | Styrene:n-butyl acrylate 78:22 | 90 | Methyltriethoxysilane | 5 | 90 |
| Toner 25 | Block polymer 8 | 10 | Styrene:n-butyl acrylate 78:22 | 90 | Methyltriethoxysilane | 5 | 90 |
| Toner 26 | Block polymer 9 | 10 | Styrene:n-butyl acrylate 78:22 | 90 | Methyltriethoxysilane | 5 | 90 |
| Toner 27 | Block polymer 10 | 10 | Styrene:n-butyl acrylate 78:22 | 90 | Methyltriethoxysilane | 5 | 90 |
| Toner 28 | Block polymer 11 | 10 | Styrene:n-butyl acrylate 78:22 | 90 | Methyltriethoxysilane | 5 | 90 |
| Toner 29 | Block polymer 12 | 10 | Styrene:n-butyl acrylate 78:22 | 90 | Methyltriethoxysilane | 5 | 90 |
| Toner 30 | Block polymer 13 | 10 | Styrene:n-butyl acrylate 78:22 | 90 | Methyltriethoxysilane | 5 | 90 |
| Toner 31 | Block polymer 14 | 10 | Styrene:n-butyl acrylate 78:22 | 90 | Methyltriethoxysilane | 5 | 90 |
| Toner 32 | Described in the specification | | | | | | |
| Toner 33 | Block polymer 1 | 10 | Styrene:n-butyl acrylate 78:22 | 90 | Tetraethoxysilane | 5 | 90 |
| Toner 34 | Block polymer 1 | 10 | Styrene:n-butyl acrylate 78:22 | 90 | Methacryloxypropyl triethoxysilane | 5 | 90 |
| Toner 35 | Block polymer 15 | 10 | Styrene:n-butyl acrylate 78:22 | 90 | Methyltriethoxysilane | 5 | 90 |
| Toner 36 | Block polymer 16 | 10 | Styrene:n-butyl acrylate 78:22 | 90 | Methyltriethoxysilane | 5 | 90 |

TABLE 4-continued

| | Reaction 2 | | Distillation | | | |
|---|---|---|---|---|---|---|
| | | | Distillation | | | |
| | Reaction time (hour) | Reaction pH | Temperature (° C.) | Distillation method | Distillation time (hour) | Distillation pH |
| Toner 1 | 1.5 | 8.0 | 100 | Atmospheric distillation | 5.0 | 8.0 |
| Toner 2 | 1.5 | 8.0 | 100 | Atmospheric distillation | 5.0 | 8.0 |
| Toner 3 | 1.5 | 8.0 | 100 | Atmospheric distillation | 5.0 | 8.0 |
| Toner 4 | 1.5 | 8.0 | 100 | Atmospheric distillation | 5.0 | 8.0 |
| Toner 5 | 1.5 | 8.0 | 100 | Atmospheric distillation | 5.0 | 8.0 |
| Toner 6 | 1.5 | 8.0 | 100 | Atmospheric distillation | 5.0 | 8.0 |
| Toner 7 | 1.5 | 8.0 | 100 | Atmospheric distillation | 5.0 | 8.0 |
| Toner 8 | 1.5 | 8.0 | 100 | Atmospheric distillation | 5.0 | 8.0 |
| Toner 9 | 1.5 | 8.0 | 100 | Atmospheric distillation | 5.0 | 8.0 |
| Toner 10 | 1.5 | 8.0 | 80 | Reduced-pressure distillation | 5.0 | 8.0 |
| Toner 11 | 1.5 | 8.0 | 85 | Reduced-pressure distillation | 5.0 | 8.0 |
| Toner 12 | 1.5 | 8.0 | 90 | Reduced-pressure distillation | 5.0 | 8.0 |
| Toner 13 | 1.5 | 8.0 | 100 | Atmospheric distillation | 5.0 | 8.0 |
| Toner 14 | 1.5 | 8.0 | 100 | Atmospheric distillation | 5.0 | 8.0 |
| Toner 15 | 1.5 | 8.0 | 100 | Atmospheric distillation | 5.0 | 8.0 |
| Toner 16 | 1.5 | 8.0 | 100 | Atmospheric distillation | 5.0 | 8.0 |
| Toner 17 | 1.5 | 8.0 | 100 | Atmospheric distillation | 5.0 | 8.0 |
| Toner 18 | 1.5 | 8.0 | 100 | Atmospheric distillation | 5.0 | 8.0 |
| Toner 19 | 1.5 | 8.0 | 100 | Atmospheric distillation | 5.0 | 8.0 |
| Toner 20 | 1.5 | 8.0 | 100 | Atmospheric distillation | 5.0 | 8.0 |
| Toner 21 | 1.5 | 8.0 | 100 | Atmospheric distillation | 5.0 | 8.0 |
| Toner 22 | 1.5 | 8.0 | 100 | Atmospheric distillation | 5.0 | 8.0 |
| Toner 23 | 1.5 | 8.0 | 100 | Atmospheric distillation | 5.0 | 8.0 |
| Toner 24 | 1.5 | 8.0 | 100 | Atmospheric distillation | 5.0 | 8.0 |
| Toner 25 | 1.5 | 8.0 | 100 | Atmospheric distillation | 5.0 | 8.0 |
| Toner 26 | 1.5 | 8.0 | 100 | Atmospheric distillation | 5.0 | 8.0 |
| Toner 27 | 1.5 | 8.0 | 100 | Atmospheric distillation | 5.0 | 8.0 |
| Toner 28 | 1.5 | 8.0 | 100 | Atmospheric distillation | 5.0 | 8.0 |
| Toner 29 | 1.5 | 8.0 | 100 | Atmospheric distillation | 5.0 | 8.0 |
| Toner 30 | 1.5 | 8.0 | 100 | Atmospheric distillation | 5.0 | 8.0 |
| Toner 31 | 1.5 | 8.0 | 100 | Atmospheric distillation | 5.0 | 8.0 |
| Toner 32 | Described in the specification | | | | | |
| Toner 33 | 1.5 | 8.0 | 100 | Atmospheric distillation | 5.0 | 8.0 |
| Toner 34 | 1.5 | 8.0 | 100 | Atmospheric distillation | 5.0 | 8.0 |

TABLE 4-continued

| | | | | | | | |
|---|---|---|---|---|---|---|---|
| | Toner 35 | 1.5 | 8.0 | 100 | Atmospheric distillation | 5.0 | 8.0 |
| | Toner 36 | 1.5 | 8.0 | 100 | Atmospheric distillation | 5.0 | 8.0 |

TABLE 5

| | Physical properties of toner | | | | | | | |
|---|---|---|---|---|---|---|---|---|
| | Number of carbon atoms in Rf | Ratio of the peak area of the partial structure represented by Formula (1) (%) | dSi/ (dC + dO + dSi + dS) | ΔSP between styrene acrylic resin and block polymer | Content of organosilicon polymer (mass %) | X/Y | Average thickness Dav. of surface layers of toner particles (nm) | Weight-average diameter D4 of toner particles (μm) |
| Toner 1 | 1 | 69.5 | 0.204 | 0.21 | 1.5 | 6.7 | 13.2 | 5.6 |
| Toner 2 | 6 | 28.5 | 0.186 | 0.21 | 1.5 | 6.7 | 5.3 | 5.5 |
| Toner 3 | 2 | 65.2 | 0.216 | 0.21 | 1.5 | 6.7 | 10.8 | 5.6 |
| Toner 4 | 6 | 39.8 | 0.187 | 0.21 | 1.5 | 6.7 | 5.1 | 5.7 |
| Toner 5 | 4 | 51.6 | 0.203 | 0.21 | 1.5 | 6.7 | 7.2 | 5.6 |
| Toner 6 | 1 | 69.7 | 0.237 | 0.21 | 4.5 | 2.2 | 27.6 | 6.0 |
| Toner 7 | 1 | 69.7 | 0.200 | 0.21 | 4.0 | 2.5 | 23.5 | 5.8 |
| Toner 8 | 1 | 69.2 | 0.070 | 0.21 | 0.5 | 20.0 | 5.3 | 5.7 |
| Toner 9 | 1 | 69.2 | 0.052 | 0.21 | 0.3 | 33.3 | 3.4 | 5.7 |
| Toner 10 | 2 | 6.2 | 0.041 | 0.21 | 1.5 | 6.7 | 8.5 | 5.5 |
| Toner 11 | 2 | 12.3 | 0.091 | 0.21 | 1.5 | 6.7 | 10.1 | 5.6 |
| Toner 12 | 2 | 41.0 | 0.142 | 0.21 | 1.5 | 6.7 | 10.6 | 5.6 |
| Toner 13 | 1 | 70.0 | 0.210 | 0.21 | 1.5 | 3.3 | 13.4 | 5.7 |
| Toner 14 | 1 | 70.3 | 0.208 | 0.21 | 1.5 | 1.3 | 13.5 | 5.8 |
| Toner 15 | 1 | 68.3 | 0.198 | 0.21 | 1.5 | 23.3 | 13.1 | 6.1 |
| Toner 16 | 1 | 69.2 | 0.209 | 0.21 | 0.5 | 4.0 | 5.4 | 5.9 |
| Toner 17 | 1 | 69.8 | 0.206 | 0.21 | 2.0 | 17.5 | 17.8 | 5.8 |
| Toner 18 | 1 | 69.9 | 0.216 | 0.21 | 3.0 | 1.7 | 20.1 | 5.9 |
| Toner 19 | 1 | 68.6 | 0.209 | 0.22 | 1.5 | 6.7 | 13.6 | 5.7 |
| Toner 20 | 1 | 68.9 | 0.210 | 0.04 | 1.5 | 6.7 | 13.2 | 5.8 |
| Toner 21 | 1 | 69.3 | 0.207 | 0.23 | 1.5 | 6.7 | 13.2 | 5.6 |
| Toner 22 | 1 | 69.4 | 0.209 | 0.04 | 1.5 | 6.7 | 13.1 | 5.6 |
| Toner 23 | 1 | 69.5 | 0.211 | 0.26 | 1.5 | 6.7 | 13.4 | 5.7 |
| Toner 24 | 1 | 69.4 | 0.210 | 0.24 | 1.5 | 6.7 | 13.3 | 5.7 |
| Toner 25 | 1 | 69.1 | 0.209 | 0.01 | 1.5 | 6.7 | 12.9 | 5.5 |
| Toner 26 | 1 | 69.6 | 0.212 | 0.23 | 1.5 | 6.7 | 13.6 | 5.7 |
| Toner 27 | 1 | 69.4 | 0.210 | 0.23 | 1.5 | 6.7 | 13.4 | 5.8 |
| Toner 28 | 1 | 69.5 | 0.206 | 0.23 | 1.5 | 6.7 | 12.8 | 5.8 |
| Toner 29 | 1 | 68.1 | 0.202 | 0.23 | 1.5 | 6.7 | 12.6 | 5.7 |
| Toner 30 | 1 | 68.9 | 0.207 | 0.25 | 1.5 | 6.7 | 13.4 | 5.7 |
| Toner 31 | 1 | 68.3 | 0.213 | 0.11 | 1.5 | 6.7 | 13.7 | 5.6 |
| Toner 32 | 1 | 68.8 | 0.190 | 0.23 | 1.5 | 6.7 | 10.2 | 5.8 |
| Toner 33 | — | — | 0.035 | 0.23 | 1.5 | 6.7 | 2.5 | 5.8 |
| Toner 34 | — | — | 0.012 | 0.23 | 1.5 | 6.7 | 2.3 | 5.6 |
| Toner 35 | 1 | 68.9 | 0.193 | 0.1 | 1.5 | 6.7 | 13.1 | 5.7 |
| Toner 36 | 1 | 69 | 0.191 | 0.26 | 3.0 | 1.7 | 12.8 | 5.7 |

Example 1

The machine used for evaluation was a "LBP9660Ci" produced by CANON KABUSHIKI KAISHA. Into a cyan cartridge, 150 g of the toner 1 was charged and evaluated in terms of the following items. Table 6 summarizes the results. The paper sheets used for evaluation (hereinafter, referred to as "evaluation sheets") were letter-size paper sheets "XEROX 4200" produced by Xerox Corporation (basis weight: 75 g/m$^2$) unless otherwise specified. In the evaluation of heat resistance, the toner particles were evaluated alone.

Low-Temperature Fixability

A solid image was printed on the evaluation sheets at a toner coverage of 0.9 mg/cm$^2$ in a normal-temperature, normal-humidity environment (25° C., 50% RH) at different fixation temperatures. The solid images were evaluated in accordance with the following criteria. Note that the fixation temperature was determined by measuring the temperature of the surface of a fixing roller with a noncontact thermometer.

Evaluation Criteria

A: Offsetting did not occur at 100° C.

B: Offsetting occurred at 100° C. or more and less than 110° C.

C: Offsetting occurred at 110° C. or more and less than 120° C.

D: Offsetting occurred at 120° C. or more.

Preservation Stability

Into a 50-mL plastic cup, 5 g of the toner 1 was charged and left to stand for 5 days in an environment of 55° C. and 20% RH. Subsequently, the presence of cohesion clusters was determined and evaluated in accordance with the following criteria.

Evaluation Criteria

A: No cohesion clusters were present.

B: Cohesion clusters were slightly present but collapsed when pressed lightly with fingers.

C: Cohesion clusters were present and did not collapsed when pressed lightly with fingers.

D: The toner particles were completely coagulated.

Environmental Stability and Development Endurance

The toner cartridge was left to stand for 24 hours in each of a low-temperature, low-humidity L/L (10° C., 15% RH) environment and a high-temperature, high-humidity H/H (33° C., 85% RH) environment. The toner cartridges that had been left to stand for 24 hours in the above environments were each attached to the "LBP9660Ci". Then, a solid image (toner coverage: 0.40 mg/cm$^2$) and a 0%-printing-rate image used in the evaluation of fogging were printed. Subsequently, a 0.5%-printing-rate image was printed on 30,000 paper sheets. After 30,000-sheet printing, a solid image, a 0%-printing-rate image, and a halftone image used in the evaluation of development stripes were printed. In addition, a sample image used in the evaluation of ghosting was printed. The sample image contained 15-mm square solid images arranged at the uppermost portion of the sample image from the left end to the right end at intervals of 15 mm and a halftone image formed in the remaining portion of the sample image with a space of 10 mm between the solid-image region and the halftone image.

Image Density

The image density of the fixed-image portion of the solid image was measured at the initial stage and after 30,000-sheet printing with a Macbeth densitometer "RD-914" produced by Macbeth which was equipped with an SPI auxiliary filter. Evaluation of image density was made in accordance with the following criteria.

A: The image density was 1.45 or more.

B: The image density was 1.35 or more and less than 1.45.

C: The image density was 1.25 or more and less than 1.35.

D: The image density was less than 1.25.

Fogging

The fogging densities (%) of the initial 0% -printing-rate image and the 0%-printing-rate image printed after 30,000-sheet printing were each calculated from the difference in whiteness degree between the white portion of the output image and the recording paper used which was measured using a "Reflectometer" produced by Tokyo Denshoku. Co., Ltd. Evaluation of image fogging was made on the basis of the fogging density in accordance with the following criteria. It was considered that, the lower the fogging density, the higher the degree of reduction in image fogging.

A: The fogging density was less than 0.5%.

B: The fogging density was 0.5% or more and less than 1.0%

C: The fogging density was 1.0% or more and less than 2.0%

D: The fogging density was 2.0% or more.

Development Stripe

After 30,000-sheet printing had been terminated, a halftone image (toner coverage: 0.25 mg/cm$^2$) was printed and evaluated in accordance with the following criteria. It is considered that toner particles having high endurance are not likely to cause development stripes to be formed, since they are not likely to be crushed or broken nor adhere to members such as a developing roller. Note that, the term "vertical streaks" used herein refers to streaks that extend in the paper-ejection direction.

A: Streaks were not present.

B: Vertical streaks were present on the image at 1 to 3 positions.

C: Vertical streaks were present on the image at 4 to 6 positions

D: Vertical streaks were present on the image at 7 positions or more, or a streak having a width of 0.5 mm or more was present.

Ghosting

The sample image described above was evaluated in terms of ghosting in accordance with the following criteria.

A: The difference in image density between a portion of the sample image which was disposed downstream of the solid-image region with a space corresponding to one revolution of the toner-carrying roller and the periphery of the above portion was 0.05 or less.

B: The difference in image density between a portion of the sample image which was disposed downstream of the solid-image region with a space corresponding to one revolution of the toner-carrying roller and the periphery of the above portion was 0.06 or more and 0.10 or less.

C: The difference in image density between a portion of the sample image which was disposed downstream of the solid-image region with a space corresponding to one revolution of the toner-carrying roller and the periphery of the above portion was 0.11 or more and 0.20 or less.

D: The difference in image density between a portion of the sample image which was disposed downstream of the solid-image region with a space corresponding to one revolution of the toner-carrying roller and the periphery of the above portion was 0.21 or more.

Examples 2 to 32

In Examples 2 to 32, the above-described evaluations were made using the toners 2 to 32 as a toner, respectively. Table 6 summarizes the results.

Comparative Examples 1 to 4

In Comparative Examples 1 to 4, the above-described evaluations were made using the toners 33 to 36 as a toner, respectively. Table 6 summarizes the results.

TABLE 6

| | | Fixability Low-temperature fixability (offsetting temperature) | | Preservation stability 55° C./5-day preservability | Development endurance and environmental stability Low-temperature, low-humidity environment | | | | | | | | | | |
|---|---|---|---|---|---|---|---|---|---|---|---|---|---|---|---|
| | | | | | Initial | | | | After 30,000-sheet printing | | | | | | |
| | | | | | Fogging | | Density | | Fogging | | Density | | Development streaks | Ghosting | |
| Example 1 | Toner 1 | 95 | A | A | 0.2 | A | 1.48 | A | 0.3 | A | 1.48 | A | A | 0.02 | A |
| Example 2 | Toner 2 | 95 | A | A | 0.4 | A | 1.47 | A | 0.5 | B | 1.48 | A | A | 0.03 | A |
| Example 3 | Toner 3 | 95 | A | A | 0.2 | A | 1.48 | A | 0.3 | A | 1.47 | A | A | 0.03 | A |
| Example 4 | Toner 4 | 95 | A | A | 0.3 | A | 1.47 | A | 0.4 | A | 1.46 | A | A | 0.03 | A |

TABLE 6-continued

| | | | | | | | | | | | | | | | |
|---|---|---|---|---|---|---|---|---|---|---|---|---|---|---|---|
| Example 5 | Toner 5 | 95 | A | A | 0.3 | A | 1.48 | A | 0.3 | A | 1.48 | A | A | 0.03 | A |
| Example 6 | Toner 6 | 105 | B | A | 0.2 | A | 1.48 | A | 0.2 | A | 1.47 | A | A | 0.05 | A |
| Example 7 | Toner 7 | 95 | A | A | 0.2 | A | 1.48 | A | 0.2 | A | 1.48 | A | A | 0.05 | A |
| Example 8 | Toner 8 | 95 | A | A | 0.3 | A | 1.47 | A | 0.4 | A | 1.48 | A | A | 0.01 | A |
| Example 9 | Toner 9 | 95 | A | B | 0.4 | A | 1.46 | A | 0.5 | B | 1.47 | A | A | 0.00 | A |
| Example 10 | Toner 10 | 95 | A | B | 0.4 | A | 1.46 | A | 0.7 | B | 1.43 | B | A | 0.04 | A |
| Example 11 | Toner 11 | 95 | A | B | 0.4 | A | 1.46 | A | 0.5 | B | 1.45 | A | A | 0.03 | A |
| Example 12 | Toner 12 | 95 | A | A | 0.3 | A | 1.47 | A | 0.4 | A | 1.46 | A | A | 0.03 | A |
| Example 13 | Toner 13 | 95 | A | A | 0.2 | A | 1.48 | A | 0.3 | A | 1.48 | A | A | 0.04 | A |
| Example 14 | Toner 14 | 100 | B | A | 0.2 | A | 1.48 | A | 0.2 | A | 1.48 | A | A | 0.11 | C |
| Example 15 | Toner 15 | 90 | A | A | 0.2 | A | 1.48 | A | 0.4 | A | 1.46 | A | A | 0.01 | A |
| Example 16 | Toner 16 | 95 | A | A | 0.2 | A | 1.48 | A | 0.3 | A | 1.48 | A | A | 0.03 | A |
| Example 17 | Toner 17 | 90 | A | A | 0.2 | A | 1.48 | A | 0.3 | A | 1.48 | A | A | 0.02 | A |
| Example 18 | Toner 18 | 95 | A | A | 0.2 | A | 1.48 | A | 0.3 | A | 1.48 | A | A | 0.08 | B |
| Example 19 | Toner 19 | 100 | B | A | 0.2 | A | 1.48 | A | 0.3 | A | 1.48 | A | A | 0.02 | A |
| Example 20 | Toner 20 | 95 | A | B | 0.2 | A | 1.47 | A | 0.4 | A | 1.46 | A | A | 0.02 | A |
| Example 21 | Toner 21 | 100 | B | A | 0.2 | A | 1.48 | A | 0.3 | A | 1.48 | A | A | 0.06 | B |
| Example 22 | Toner 22 | 95 | A | A | 0.2 | A | 1.48 | A | 0.4 | A | 1.48 | A | A | 0.04 | A |
| Example 23 | Toner 23 | 100 | B | A | 0.2 | A | 1.48 | A | 0.2 | A | 1.48 | A | A | 0.03 | A |
| Example 24 | Toner 24 | 95 | A | A | 0.2 | A | 1.48 | A | 0.3 | A | 1.48 | A | A | 0.04 | A |
| Example 25 | Toner 25 | 90 | A | B | 0.2 | A | 1.47 | A | 0.4 | A | 1.46 | A | A | 0.02 | A |
| Example 26 | Toner 26 | 105 | B | A | 0.2 | A | 1.48 | A | 0.2 | A | 1.47 | A | A | 0.03 | A |
| Example 27 | Toner 27 | 100 | B | A | 0.2 | A | 1.48 | A | 0.2 | A | 1.47 | A | A | 0.03 | A |
| Example 28 | Toner 28 | 95 | A | A | 0.2 | A | 1.48 | A | 0.4 | A | 1.48 | A | A | 0.03 | A |
| Example 29 | Toner 29 | 90 | A | B | 0.3 | A | 1.47 | A | 0.4 | A | 1.46 | A | A | 0.03 | A |
| Example 30 | Toner 30 | 90 | A | A | 0.2 | A | 1.48 | A | 0.5 | B | 1.46 | A | A | 0.04 | A |
| Example 31 | Toner 31 | 100 | B | A | 0.2 | A | 1.48 | A | 0.3 | A | 1.48 | A | A | 0.04 | A |
| Example 32 | Toner 32 | 100 | B | B | 0.3 | A | 1.47 | A | 0.5 | B | 1.44 | B | B | 0.04 | A |
| Comparative example 1 | Toner 33 | 95 | A | C | 0.3 | A | 1.46 | A | 0.9 | B | 1.40 | B | C | 0.05 | A |
| Comparative example 2 | Toner 34 | 95 | A | C | 0.3 | A | 1.46 | A | 0.7 | B | 1.41 | B | C | 0.07 | B |
| Comparative example 3 | Toner 35 | 115 | C | A | 0.4 | A | 1.46 | A | 0.4 | A | 1.46 | A | A | 0.07 | B |
| Comparative example 4 | Toner 36 | 105 | B | C | 0.3 | A | 1.47 | A | 0.7 | B | 1.44 | B | B | 0.11 | C |

| | Development endurance and environmental stability High-temperature, high-humidity environment | | | | | | | | | | |
|---|---|---|---|---|---|---|---|---|---|---|---|
| | | | | | After 30,000-sheet printing | | | | | | |
| | Initial | | | | | | | | Development | | |
| | Fogging | | Density | | Fogging | | Density | | streaks | Ghosting | |
| Example 1 | 0.3 | A | 1.47 | A | 0.4 | A | 1.46 | A | A | 0.01 | A |
| Example 2 | 0.6 | B | 1.45 | A | 0.9 | B | 1.44 | B | A | 0.02 | A |
| Example 3 | 0.4 | A | 1.46 | A | 0.4 | A | 1.46 | A | A | 0.01 | A |
| Example 4 | 0.5 | B | 1.46 | A | 0.7 | B | 1.45 | A | A | 0.02 | A |
| Example 5 | 0.4 | A | 1.46 | A | 0.6 | B | 1.46 | A | A | 0.01 | A |
| Example 6 | 0.3 | A | 1.47 | A | 0.3 | A | 1.47 | A | A | 0.03 | A |
| Example 7 | 0.3 | A | 1.47 | A | 0.3 | A | 1.47 | A | A | 0.03 | A |
| Example 8 | 0.3 | A | 1.46 | A | 0.4 | A | 1.46 | A | A | 0.01 | A |
| Example 9 | 0.5 | B | 1.45 | A | 0.8 | B | 1.43 | B | A | 0.00 | A |
| Example 10 | 0.7 | B | 1.43 | B | 1.2 | B | 1.39 | B | A | 0.02 | A |
| Example 11 | 0.5 | B | 1.45 | A | 1.0 | B | 1.41 | B | A | 0.02 | A |
| Example 12 | 0.5 | B | 1.46 | A | 0.7 | B | 1.45 | A | A | 0.02 | A |
| Example 13 | 0.3 | A | 1.47 | A | 0.4 | A | 1.46 | A | A | 0.02 | A |
| Example 14 | 0.3 | A | 1.47 | A | 0.3 | A | 1.46 | A | A | 0.05 | A |
| Example 15 | 0.3 | A | 1.46 | A | 0.6 | B | 1.44 | B | A | 0.01 | A |
| Example 16 | 0.3 | A | 1.47 | A | 0.4 | A | 1.46 | A | A | 0.01 | A |
| Example 17 | 0.3 | A | 1.47 | A | 0.4 | A | 1.45 | A | A | 0.01 | A |
| Example 18 | 0.3 | A | 1.47 | A | 0.4 | A | 1.46 | A | A | 0.04 | A |
| Example 19 | 0.3 | A | 1.47 | A | 0.4 | A | 1.46 | A | A | 0.01 | A |
| Example 20 | 0.4 | A | 1.45 | A | 0.7 | B | 1.43 | B | A | 0.01 | A |
| Example 21 | 0.3 | A | 1.48 | A | 0.4 | A | 1.46 | A | A | 0.03 | A |
| Example 22 | 0.3 | A | 1.46 | A | 0.4 | A | 1.45 | A | A | 0.02 | A |
| Example 23 | 0.2 | A | 1.48 | A | 0.3 | A | 1.46 | A | A | 0.02 | A |
| Example 24 | 0.3 | A | 1.47 | A | 0.4 | A | 1.46 | A | A | 0.02 | A |
| Example 25 | 0.4 | A | 1.45 | A | 0.8 | B | 1.42 | B | A | 0.02 | A |
| Example 26 | 0.3 | A | 1.47 | A | 0.3 | A | 1.47 | A | A | 0.02 | A |
| Example 27 | 0.3 | A | 1.47 | A | 0.4 | A | 1.46 | A | A | 0.02 | A |
| Example 28 | 0.3 | A | 1.47 | A | 0.4 | A | 1.46 | A | A | 0.02 | A |
| Example 29 | 0.4 | A | 1.45 | A | 0.9 | B | 1.41 | B | B | 0.02 | A |
| Example 30 | 0.4 | A | 1.47 | A | 0.9 | B | 1.42 | B | B | 0.02 | A |
| Example 31 | 0.3 | A | 1.48 | A | 0.4 | A | 1.46 | A | A | 0.02 | A |
| Example 32 | 0.4 | A | 1.45 | A | 0.7 | B | 1.43 | B | B | 0.02 | A |
| Comparative example 1 | 1.4 | B | 1.42 | B | 3.0 | D | 1.24 | D | D | 0.03 | A |

TABLE 6-continued

| | | | | | | | | | | | |
|---|---|---|---|---|---|---|---|---|---|---|---|
| Comparative example 2 | 1.4 | B | 1.42 | B | 2.8 | C | 1.33 | C | D | 0.04 | A |
| Comparative example 3 | 0.3 | A | 1.46 | A | 0.4 | A | 1.46 | A | A | 0.04 | A |
| Comparative example 4 | 0.4 | A | 1.45 | A | 1.6 | C | 1.39 | B | C | 0.06 | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110380, filed May 29, 2015, which is hereby incorporated by reference herein in its entirety.

What is claimed is:

1. A toner comprising a toner particle including a surface layer, wherein:

the toner particle comprises a styrene acrylic resin and a block polymer;

the surface layer comprises an organosilicon polymer;

the organosilicon polymer has a partial structure represented by Formula (1) below, $$Rf—SiO_{3/2} \quad (1)$$

where Rf represents an alkyl group having 1 to 6 carbon atoms, or a phenyl group;

the block polymer has a polyester segment C and a vinyl polymer segment A;

a mass ratio C/A of the polyester segment C to the vinyl polymer segment A is 40/60 or more and 80/20 or less;

the polyester segment C has a structural unit represented by Formula (2) below; and the block polymer has a melting point Tm of 55° C. or more and 90° C. or less,

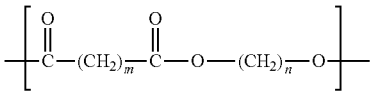

(2)

where m and n each independently represent an integer of 4 to 16.

2. The toner according to claim 1, wherein, in a $^{29}$Si-NMR measurement of a tetrahydrofuran-insoluble matter of the toner particle, the ratio of a peak area corresponding to the partial structure represented by Formula (1) to a total peak area corresponding to the organosilicon polymer is 5.0% or more.

3. The toner according to claim 1, wherein the block polymer has a weight-average molecular weight Mw of 15,000 or more and 45,000 or less.

4. The toner according to claim 1, wherein the vinyl polymer segment A includes a unit derived from styrene.

5. The toner according to claim 1, wherein the absolute value ΔSP of the difference between the solubility parameter (SP) of the styrene acrylic resin and the SP of the block polymer is 0.03 or more and 0.25 or less.

6. The toner according to claim 1, wherein, in X-ray photoelectron spectroscopic analysis (ESCA) of a surface of the toner particle, a ratio of silicon atoms calculated by the following formula is 0.025 or more, $$dSi/(dC+dO+dSi+dS)$$

where dC represents the intensity corresponding to carbon atoms, dO represents the intensity corresponding to oxygen atoms, dSi represents the intensity corresponding to silicon atoms, and dS represents the intensity corresponding to sulfur atoms.

7. The toner according to claim 1, wherein the amount of the organosilicon polymer is 0.5% by mass or more and 4.0% by mass or less of the total amount of the toner particle.

8. The toner according to claim 1, wherein the ratio of X to Y is 1.5 or more and 30.0 or less, where X represents the proportion of the mass of the block polymer to the total mass of the block polymer and the styrene acrylic resin, and Y represents the proportion of the mass of the organosilicon polymer to the total mass of the toner particle.

9. A method for producing a toner comprising a toner particle including a surface layer, wherein:

the toner particle comprises a styrene acrylic resin and a block polymer;

the surface layer comprises an organosilicon polymer;

the method comprising:

forming a particle of a polymerizable monomer composition in an aqueous medium, the polymerizable monomer composition including a polymerizable monomer capable of forming the styrene acrylic resin, the block polymer, and a silicon compound capable of forming the organosilicon polymer, and polymerizing the polymerizable monomer included in the particle, the organosilicon polymer has a partial structure represented by Formula (1) below, $$Rf—SiO_{3/2} \quad (1)$$

where Rf represents an alkyl group having 1 to 6 carbon atoms, or a phenyl group;

the block polymer has a polyester segment C and a vinyl polymer segment A;

a mass ratio C/A of the polyester segment C to the vinyl polymer segment A is 40/60 or more and 80/20 or less;

the polyester segment C has a structural unit represented by Formula (2) below; and the block polymer has a melting point Tm of 55° C. or more and 90° C. or less,

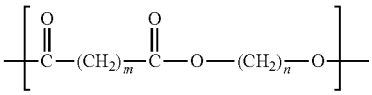

(2)

where m and n each independently represent an integer of 4 to 16.

* * * * *